US010725412B2

(12) United States Patent
Mandachi et al.

(10) Patent No.: US 10,725,412 B2
(45) Date of Patent: Jul. 28, 2020

(54) IMAGE FORMING APPARATUS THAT PERFORMS DISPLAY FOR REPLACEMENT OF DEVELOPER CONTAINER

(71) Applicant: CANON KABUSHIKI KAISHA, Tokyo (JP)

(72) Inventors: Yojiro Mandachi, Hamamatsu (JP); Hidenori Matsumoto, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/376,272

(22) Filed: Apr. 5, 2019

(65) Prior Publication Data

US 2019/0317439 A1 Oct. 17, 2019

(30) Foreign Application Priority Data

Apr. 12, 2018 (JP) ..... 2018-076896

(51) Int. Cl.
*G03G 15/00* (2006.01)
*G03G 15/08* (2006.01)

(52) U.S. Cl.
CPC ..... *G03G 15/5016* (2013.01); *G03G 15/0867* (2013.01); *G03G 15/556* (2013.01); *G03G 2215/0675* (2013.01)

(58) Field of Classification Search
CPC ..... G03G 15/0867; G03G 15/5016; G03G 15/502; G03G 15/55; G03G 15/553; G03G 15/556; G03G 2215/066; G03G 2215/0675
See application file for complete search history.

(56) References Cited

U.S. PATENT DOCUMENTS

| | | | |
|---|---|---|---|
| 7,653,334 | B2 | 1/2010 | Matsunai |
| 2006/0039709 | A1 | 2/2006 | Odani |
| 2006/0045546 | A1 | 3/2006 | Okochi |
| 2006/0216046 | A1 | 9/2006 | Hatakeyama |
| 2007/0003296 | A1 | 1/2007 | Miyata |
| 2007/0189781 | A1 | 8/2007 | Katogi |
| 2010/0329704 | A1 | 12/2010 | Tachibana |
| 2012/0250064 | A1 | 10/2012 | Wood |
| 2013/0028617 | A1 | 1/2013 | Fukuoka |

(Continued)

OTHER PUBLICATIONS

Copending U.S. Appl. No. 16/376,090, filed Apr. 5, 2019.

(Continued)

*Primary Examiner* — Sophia S Chen
(74) *Attorney, Agent, or Firm* — Rossi, Kimms & McDowell LLP

(57) ABSTRACT

An image forming apparatus on which a developer container is replaceably mounted and which is improved in usability. An image forming unit of the apparatus forms an image using developer contained in a container which is mounted on a mount section. A replenishment mechanism replenishes the developer in the container to the image forming unit, and a cover is opened to mount the container on the mount section and is closed to protect the container mounted on the mount section. If the cover is opened after it is closed in a state in which the container has been removed from the mount section while a predetermined condition related to a remaining amount of the developer in the container is not satisfied, a remount screen is displayed for prompting a user to remount the removed container.

13 Claims, 15 Drawing Sheets

(56) References Cited

U.S. PATENT DOCUMENTS

| | | | | |
|---|---|---|---|---|
| 2013/0136459 | A1 | 5/2013 | Hirama | |
| 2014/0105619 | A1 | 4/2014 | Elliott | |
| 2015/0010313 | A1 | 1/2015 | Nakajima | |
| 2015/0104200 | A1 | 4/2015 | Matsumoto | |
| 2018/0299816 | A1* | 10/2018 | Sakaguchi ..... | G03G 15/502 |

OTHER PUBLICATIONS

Office Action issued in U.S. Appl. No. 16/376,090 dated Dec. 30, 2019.
Notice of Allowance issued in U.S. Appl. No. 16/376,090 dated Apr. 7, 2020.

* cited by examiner

FIG. 13A

△ Toner container of color below, which can continue to be used, has been removed.

・Yellow

Set removed toner container again.
Thank you for your cooperation in regards to effective use of limited resources.

FIG. 13B

△ Toner container indicated below, which contains remaining toner, has been removed. Please perform return operation.

・Yellow

Return operation:
Remove the toner container of the color, and set again the toner container set before replacement.

FIG. 13C

△ Toner bottle is not set.
Set toner bottle.

FIG. 13D

Door is open.
Close door.

IMAGE FORMING APPARATUS THAT PERFORMS DISPLAY FOR REPLACEMENT OF DEVELOPER CONTAINER

BACKGROUND OF THE INVENTION

Field of the Invention

The present invention relates to an image forming apparatus on and from which a container containing developer can be mounted and removed, and a method of controlling the same.

Description of the Related Art

An electrophotographic image forming apparatus forms an image by developing an electrostatic latent image formed on a photosensitive member using developer in a developing unit (developing device). The amount of developer which can be stored in the developing unit is limited, and hence developer is replenished from a container which can be mounted on and removed from the image forming apparatus, as required. Further, the amount of developer in the container is also limited, and hence if the developer in the container runs out, the developer cannot be replenished from the container to the developing unit. Therefore, in a case where the developer in the container runs out, the image forming apparatus notifies the user of the necessity of replacing the container.

However, the user sometimes replaces the container even though the amount of developer remaining in the container is not smaller than a first predetermined amount. To prevent this, an image forming apparatus described in U.S. Patent Application Publication No. 2006/0045546 displays, in a case where a container has been removed before becoming empty, a warning screen for providing a warning to notify the user that developer remains in the container and the container can be still used. According to U.S. Patent Application Publication No. 2006/0045546, the image forming operation can be executed by remounting the container which is not empty, and hence it is possible to prevent disposal of the container in which developer remains.

Incidentally, there is a case where the image forming apparatus cannot normally detect mounting of a container even though the user has mounted the container on a mount section. If the warning screen continues to be displayed in the case where mounting of the container could not be normally detected, the user may repeat the operation prompted by the warning screen. For example, the user may unnecessarily repeat mounting and removal of the container. For this reason, in a case where a door of the mount section, which is opened and closed for mounting and removing the container, is closed, it is preferable to display a screen different from the warning screen.

On the other hand, if a screen different from the warning screen is displayed because the door is closed, there is no opportunity for prompting the user to reattach the removed container again. Further, there is conventionally used an apparatus that can close the door of the mount section in a state in which a container is not mounted on the mount section. In the apparatus of this type as well, after the above-mentioned warning screen is once displayed, in a state in which the container containing remaining developer in an amount not smaller than the first predetermined amount has been removed, if a screen different from the warning screen is displayed due to closing of the door, there is no longer an opportunity for prompting the user again to remount the removed container. Therefore, since it is impossible to notify the user again that the container can still be used, the container containing remaining developer can be wastefully discarded.

SUMMARY OF THE INVENTION

The present invention provides an image forming apparatus on which a developer container is replaceably mounted and which is improved in usability.

In a first aspect of the present invention, there is provided an image forming apparatus comprising an image forming unit configured to form an image using developer, a mount section on which a container containing developer is mounted, a replenishment mechanism configured to replenish developer in the container mounted on the mount section to the image forming unit, a cover that is opened to mount the container on the mount section and is closed to protect the container mounted on the mount section, and a display configured to display, in a case where the cover is opened after the cover is closed in a state in which the container has been removed from the mount section while a predetermined condition related to a remaining amount of the developer in the container is not satisfied, a remount screen for prompting a user to remount the removed container.

In a second aspect of the present invention, there is provided an image forming apparatus comprising an image forming unit configured to form an image using developer, a mount section on which a container containing developer is mounted, a replenishment mechanism configured to replenish the developer in the container mounted on the mount section to the image forming unit, a cover that is opened to mount the container on the mount section and is closed to protect the container mounted on the mount section, and a display configured to display, in a case where the container is removed from the mount section while the predetermined condition is not satisfied, a first screen for prompting a user to remount the removed container, display a second screen which is different from the first screen in a case where the cover is closed after the first screen is displayed, and display the first screen again in a case where the cover is opened after the second screen is displayed.

In a third aspect of the present invention, there is provided an image forming apparatus comprising an image forming unit configured to form an image using developer, a mount section on which a container containing developer is mounted, a replenishment mechanism configured to replenish the developer in the container mounted on the mount section to the image forming unit, a cover that is opened to mount the container on the mount unit and is closed to protect the container mounted on the mount section, and a display configured to display, in a case where the container is removed from the mount section while the predetermined condition is not satisfied, a screen for prompting a user to remount the removed container, hide the screen in a case where the cover is closed after the screen is displayed, and display the screen again in a case where the cover is opened after the screen is hidden.

According to the present invention, it is possible to improve the usability of an image forming apparatus on which a developer container is replaceably attached.

Further features of the present invention will become apparent from the following description of exemplary embodiments (with reference to the attached drawings).

BRIEF DESCRIPTION OF THE DRAWINGS

FIGS. 13A to 13D are views each showing an example of a screen displayed on a liquid crystal display.

DESCRIPTION OF THE EMBODIMENTS

The present invention will now be described in detail below with reference to the accompanying drawings showing embodiments thereof.

Figure 1:
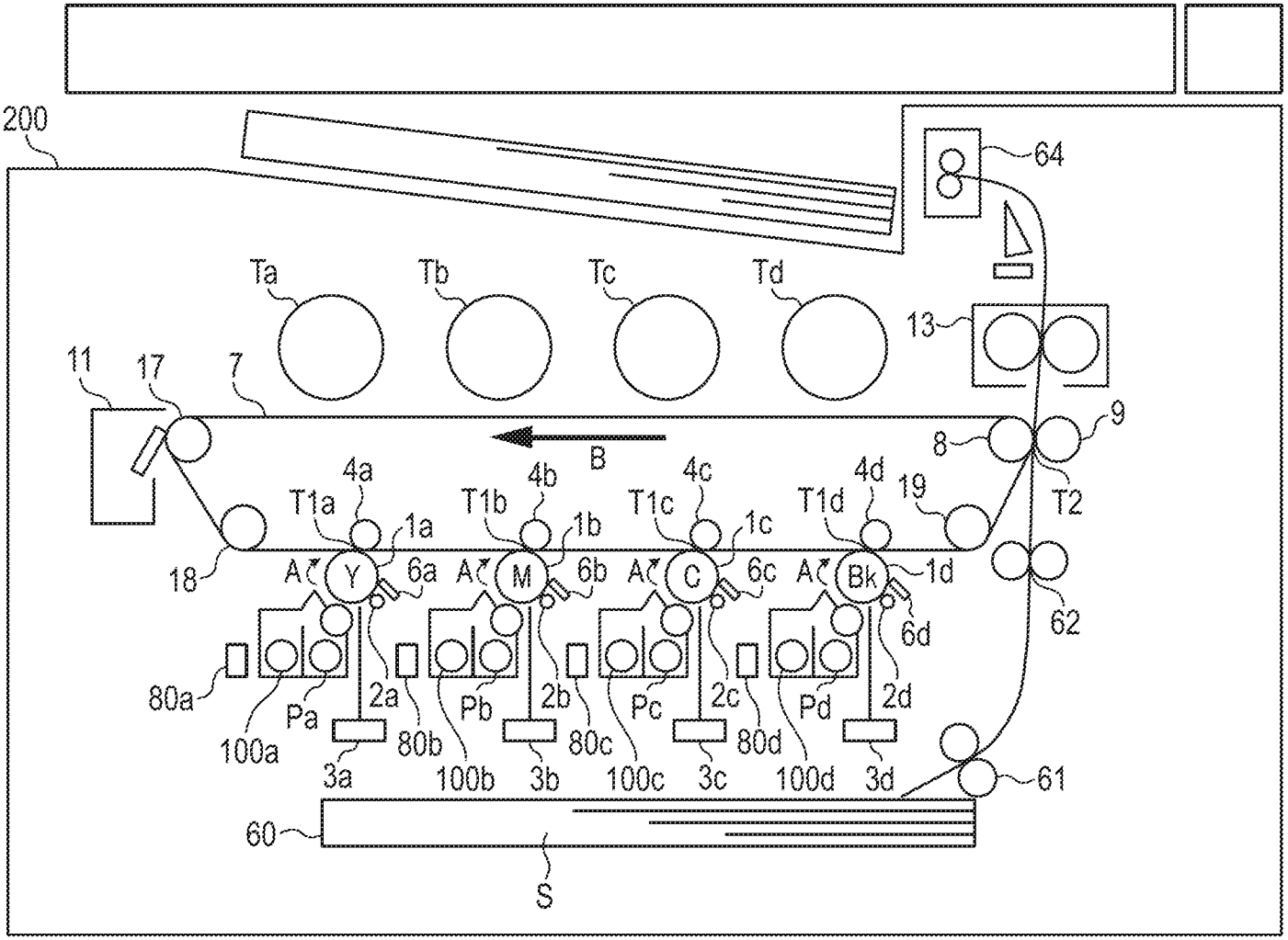
FIG. 1 is a view of an image forming apparatus.

FIG. 1 is a view of an image forming apparatus according to an embodiment of the present invention. This image forming apparatus, denoted by reference numeral 200, includes a plurality of image forming sections P (Pa, Pb, Pc, and Pd) for forming images of different colors, respectively. The image forming sections Pa, Pb, Pc, and Pd form toner images of yellow (Y), magenta (M), cyan (C), and black (Bk), respectively. In a main body of the image forming apparatus 200, there are removably provided toner containers T (Ta, Tb, Tc, and Td) for storing developer (toner) of the colors corresponding to the image forming sections Pa, Pb, Pc, and Pd, respectively. Each toner container T is also referred to as the toner bottle or the storage container. The toner container Ta stores toner of yellow and replenishes the toner of yellow to the image forming section Pa. The toner container Tb stores toner of magenta and replenishes the toner of magenta to the image forming section Pb. The toner container Tc stores toner of cyan and replenishes the toner of cyan to the image forming section Pc. The toner container Td stores toner of black and replenishes the toner of black to the image forming section Pd.

The image forming sections Pa to Pd have the same configuration. The image forming sections P are not limited to ones that form toner images of the four colors of yellow, magenta, cyan, and black, but may be image forming sections that form toner images of other colors. Note that the arrangement of the image forming sections Pa, Pb, Pc, and Pd are not limited to the illustrated example in FIG. 1. Each of the image forming sections P includes a photosensitive member 1 (1*a*, 1*b*, 1*c*, 1*d*), a charger 2 (2*a*, 2*b*, 2*c*, 2*d*), a developing device 100 (100*a*, 100*b*, 100*c*, 100*d*), and a drum cleaner 6 (6*a*, 6*b*, 6*c*, 6*d*). Around each of the image forming sections P, there are arranged an exposure device 3 (3*a*, 3*b*, 3*c*, 3*d*) and a primary transfer section 4 (4*a*, 4*b*, 4*c*, 4*d*). In the following description, when the component elements corresponding to the respective colors are not specifically distinguished, the same reference numeral is used, whereas when the component elements are distinguished, a, b, c, and d are each added as a suffix to the reference numeral.

The photosensitive member 1 is of a drum type and includes a photosensitive layer on the surface of a metal roller. The photosensitive member 1 is rotated in a direction indicated by an arrow A when forming an image. The charger 2 uniformly charges the surface of the photosensitive member 1. The photosensitive member 1 with the charged surface is scanned by a laser beam irradiated from the exposure device 3 based on image data of an image of an associated color. As a result, an electrostatic latent image of the image of the associated color is formed on the surface of the photosensitive member 1. The developing device 100 forms a toner image on the photosensitive member 1 by developing the electrostatic latent image with toner. The developing device 100 includes a density sensor 80 (80*a*, 80*b*, 80*c*, 80*d*) (described hereinafter with reference to FIG. 2) for detecting a density of toner stored therein. In a case where a result of detection by the density sensor 80 indicates that the toner density is lowered, toner is replenished from an associated one of the toner containers T to the developing device 100. The developing device 100 stores two-component developer in which non-magnetic toner and magnetic carrier are mixed, or one-component developer containing only magnetic toner or non-magnetic toner. In the present embodiment, it is assumed that two-component developer is used.

An intermediate transfer belt 7 is arranged above the image forming sections Pa to Pd. Each primary transfer section 4 is disposed at a location opposed to an associated one of the image forming sections P across the intermediate transfer belt 7. A primary transfer nip T1 (T1*a*, T1*b*, T1*c*, T1*d*) is formed between each photosensitive member 1 and an associated one of the primary transfer sections 4. When the intermediate transfer belt 7 passes through each primary transfer nip T1, a toner image formed on each photosensitive member 1 is transferred onto the intermediate transfer belt 7. Toner remaining on the photosensitive member 1 after the transfer of the toner image is removed by the drum cleaner 6. The intermediate transfer belt 7 is an endless belt stretched around a secondary transfer inner roller 8, a driven roller 17, and tension rollers 18 and 19. When the intermediate transfer belt 7 is rotated in a direction indicated by an arrow B in accordance with rotation of the secondary transfer inner roller 8, the toner image transferred onto the intermediate transfer belt 7 is conveyed in the direction indicated by the arrow B. A secondary transfer roller 9 is disposed at a location opposed to the secondary transfer inner roller 8 across the intermediate transfer belt 7. A secondary transfer section T2 as a transfer nip is formed between the secondary transfer inner roller 8 and the secondary transfer roller 9. When the intermediate transfer belt 7 and a sheet S pass the secondary transfer section T2, the toner image formed on the intermediate transfer belt 7 is transferred onto the sheet S. Toner remaining on the intermediate transfer belt 7 after the transfer of the toner image is removed by a belt cleaner 11.

The sheet S is stored in a cassette 60 and is conveyed to the secondary transfer section T2 in tune with the timing at which the toner image formed on the intermediate transfer belt 7 is conveyed to the secondary transfer section T2. First, the sheet S stored in the cassette 60 is fed by a roller 61, and is conveyed through a conveying path to a registration roller pair 62. The registration roller pair 62 performs skew correction, etc., on the sheet S, and then conveys the sheet S in synchronism with the timing at which the sheet S is brought into contact with the toner image on the intermediate transfer belt 7 at the secondary transfer section T2. The sheet S on which the toner image has been transferred at the secondary transfer section T2 is conveyed to a fixing device 13. The fixing device 13 includes a heater as a heat source and is controlled to always keep an optimum temperature. The fixing device 13 applies predetermined pressure and a predetermined amount of heat to the sheet S passing through a fixing nip formed by opposed two rollers to thereby melt and fix the toner image on the sheet S. The sheet S on which the toner image has been fixed is discharged from the image forming apparatus 200 by rollers 64.

Figure 2:
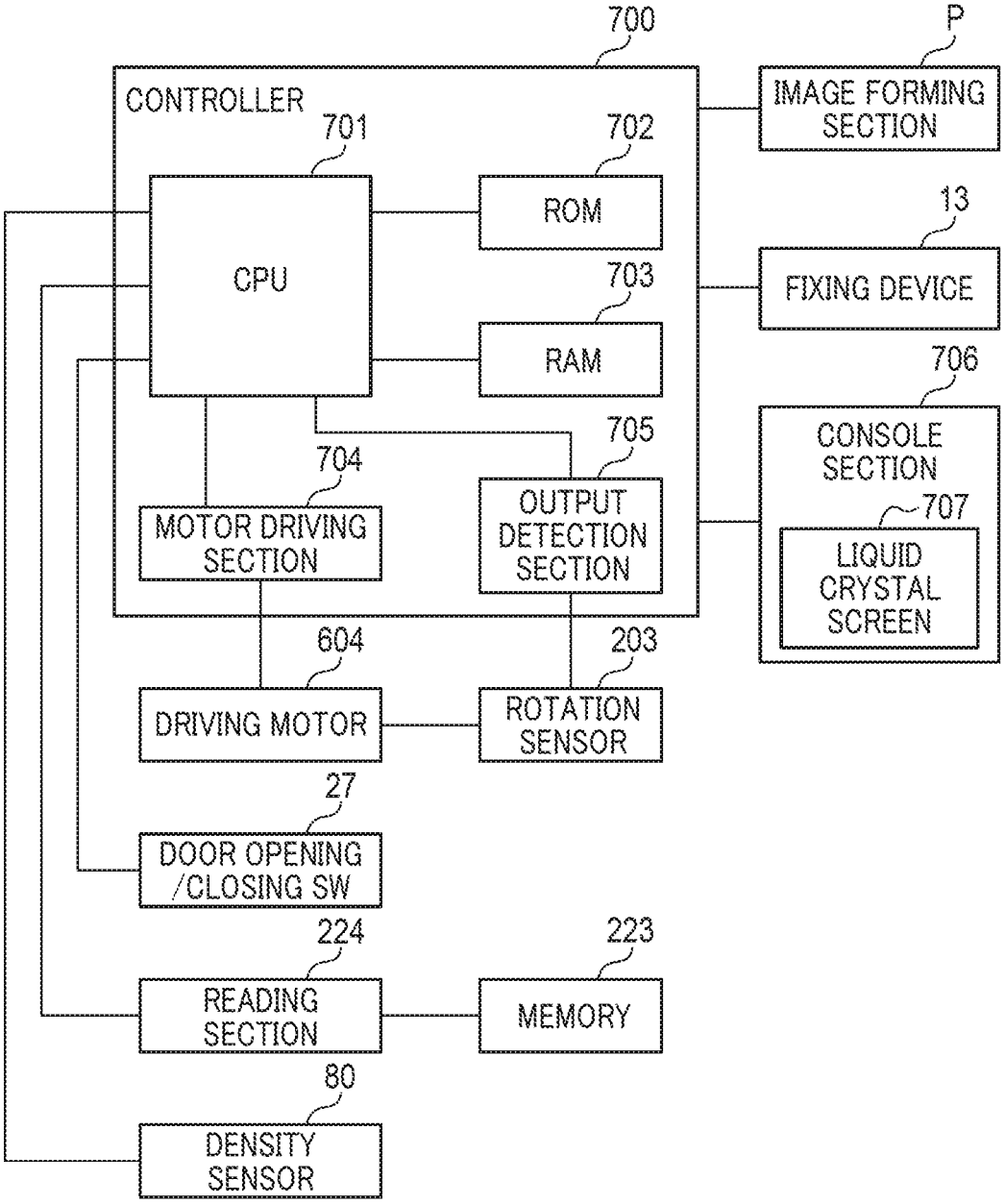
FIG. 2 is a control block diagram of the image forming apparatus.

FIG. 2 is a control block diagram of the image forming apparatus 200. A controller 700 controls the overall operation of the image forming apparatus 200. The controller 700 includes a CPU 701, a ROM 702, a RAM 703, a motor driving section 704, and an output detection section 705.

The CPU 701 is a control circuit for controlling the devices of the image forming apparatus 200. The ROM 702 stores control programs for controlling various processes executed by the image forming apparatus 200. The RAM 703 is a system work memory used by the CPU 701 that executes the control programs.

The density sensor 80 outputs a signal indicative of a magnetic permeability varied e.g. based on the amount of toner in the developing device 100. Note that the density sensor 80 is not limited to the sensor that outputs a signal indicative of a magnetic permeability varied based on the amount of toner in the developing device 100, but any other suitable sensor may be employed insofar as it can detect an amount of toner in the developing device 100. The CPU 701 converts the signal output from the density sensor 80 to a toner density based on a conversion table, not shown. The CPU 701 controls replenishment of toner from the toner container T to the developing device 100 such that the toner density becomes a target density.

A console section 706 includes a liquid crystal display 707, such as a touch panel. The liquid crystal display 707 of the console section 706 displays various screens, such as a warning screen and an unmounted screen, according to a signal output from the CPU 701. Further, the console section 706 notifies the user of a state of the image forming apparatus 200 according to a signal output from the CPU 701. Note that the display of the screens is performed not limitedly on the liquid crystal display 707, but, for example, may be displayed on the monitor of a PC communicably connected to the image forming apparatus 200 via a network.

A driving motor 604 is a drive source for rotating the toner container T so as to replenish toner from the toner container T to the developing device 100. The motor driving section 704 controls current supplied to the driving motor 604 so as to control the driving motor 604. The CPU 701 sets a PWM value as a control value indicative of a ratio of time during which current is supplied to the driving motor 604 to a predetermined time period. With this, the motor driving section 704 controls current supplied to the driving motor 604 based on the PWM value. A DC motor (DC brush motor) is used as the driving motor 604. For this reason, the rotational speed of the driving motor 604 and the rotational driving force of the driving motor 604 vary with the ratio of time during which current is supplied to the driving motor 604 to the predetermined time period.

Note that the motor driving section 704 can supply current to the driving motor 604 during time in which the CPU 701 outputs an ENB (enable) signal. That is, the motor driving section 704 supplies current to the driving motor 604 based on the PWM value during time in which the CPU 701 outputs the ENB signal. This drives the toner container T for rotation. On the other hand, when the CPU 701 stops outputting the ENB signal, the motor driving section 704 stops supplying current to the driving motor 604. This stops the rotation of the toner container T.

A rotation sensor 203 is an optical sensor including a light emission section and a light receiving section, and outputs a signal indicative of an amount of light received by the light receiving section. The amount of light received by the rotation sensor 203 is not smaller than a threshold value during time in which a predetermined area (outer peripheral portion 221; see FIGS. 5B, 5C, 6A, and 6B) of the toner container T is passing a detection position in a rotational direction of the toner container T. On the other hand, the amount of light received by the rotation sensor 203 is smaller than the threshold value during time in which an area of the toner container T other than the predetermined area is passing the detection position in the rotational direction of the toner container T. Note that details of the rotation sensor 203 will be described hereinafter with reference to FIGS. 6A and 6B.

The output detection section 705 outputs a rotation detection signal as an output signal indicative of a rotational position of the toner container T based on the signal output from the rotation sensor 203. More specifically, the output detection section 705 outputs a signal at a low level if the amount of light received by the rotation sensor 203 is not smaller than the threshold value, and outputs a signal at a high level if the amount of light received by the rotation sensor 203 is smaller than the threshold value. Therefore, the output detection section 705 outputs the signal at the low level during time in which the predetermined area of the toner container T is passing the detection position, and outputs the signal at the high level during time in which the area of the toner container T other than the predetermined area is passing the detection position.

A reading section 224 reads replenishment information recorded in a memory 223 of the toner container T mounted on the mount section of the image forming apparatus 200, and notifies the CPU 701 of the read information. Further, the reading section 224 can write replenishment information notified from the CPU 701 into the memory 223 of the toner container T. This replenishment information includes a color of toner stored in the toner container T, an identification number of the toner container T, and replenishment history of the toner container T, for example. Note that the replenishment history of the toner container T refers e.g. to the number of times of rotation of the toner container T. The CPU 701 records information on the number of times of rotation of the toner container T in the memory 223 (see FIGS. 5A to 5C) using the reading section 224 whenever the toner container T turns half rotation. The number of times of rotation of the toner container T corresponds to the number of times of replenishment of toner (strictly, half of the same).

The motor driving section 704, the output detection section 705, the rotation sensor 203, and the reading section 224 are provided on a color-by-color basis. The driving motor 604 is also provided on a color-by-color basis. However, the driving motor 604 may be provided such that the plurality of toner containers T are rotated by one driving motor. If the transmission of the driving force from the driving motor 604 to the toner container T is configured to be controllable such that it can be switched by a clutch between an enabled state in which the driving force can be transmitted and a disabled state in which the driving force cannot be transmitted, one driving motor 604 can selectively drive the plurality of toner containers T for rotation.

A door opening/closing SW (switch) 27 outputs an opening/closing detection signal to the CPU 701 according to an opened/closed state of a door 26 (see FIG. 3) of the image forming apparatus 200. The opening/closing detection signal is e.g. a binary signal. If the opening/closing detection signal is at the low level, the CPU 701 determines that the door 26 is in the closed state. On the other hand, if the opening/closing detection signal is at the high level, the CPU 701 determines that the door 26 is in the opened state. In short, the CPU 701 determines whether the door 26 is in the opened or closed state based on the opening/closing detection signal.

Figure 3:
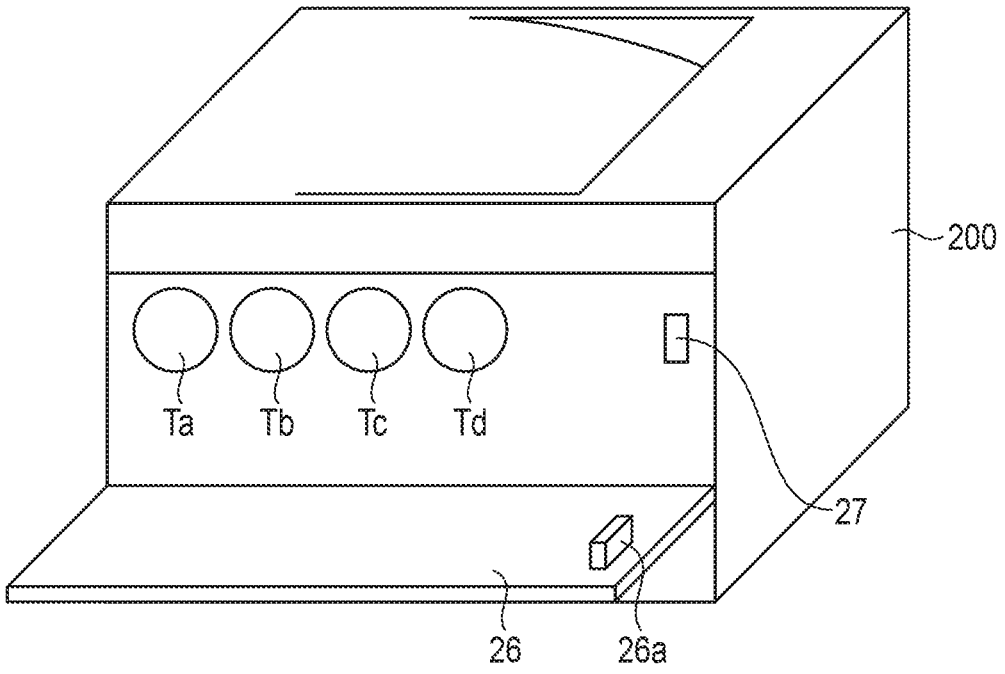
FIG. 3 is a perspective view of the image forming apparatus.

Here, the door 26 of the image forming apparatus 200 will be described with reference to FIG. 3. FIG. 3 is a perspective view of the image forming apparatus 200. Referring to FIG. 3, the image forming apparatus 200 is provided with the door 26 which is opened and closed by a user to mount and remove the toner container T. The door 26 is provided with a protrusion 26*a*. When the door 26 is closed, the protrusion 26*a* presses the door opening/closing SW 27. When the door opening/closing SW 27 is pressed by the protrusion 26*a*, the door opening/closing SW 27 outputs a signal at a low level. On the other hand, when the door opening/closing SW 27 is released from the state pressed by the protrusion 26*a*, the door opening/closing SW 27 outputs a signal at a high level. Note that the door 26 may be a door for opening and closing only a mount section 310 (see FIG. 4) on which each toner container T associated therewith is mounted. Alternatively, the door 26 may be an opening/closing member configured to open and close the entire one side of the image forming apparatus 200.

Figure 4A:
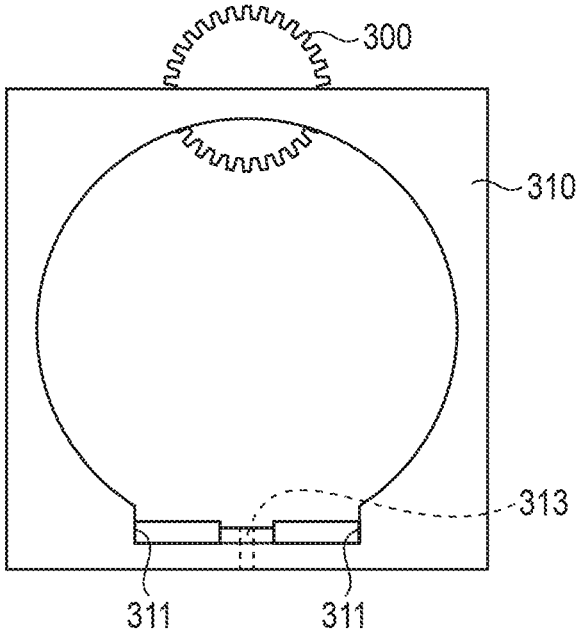
FIG. 4A is a partial front view of a mount section.
Figure 4B:
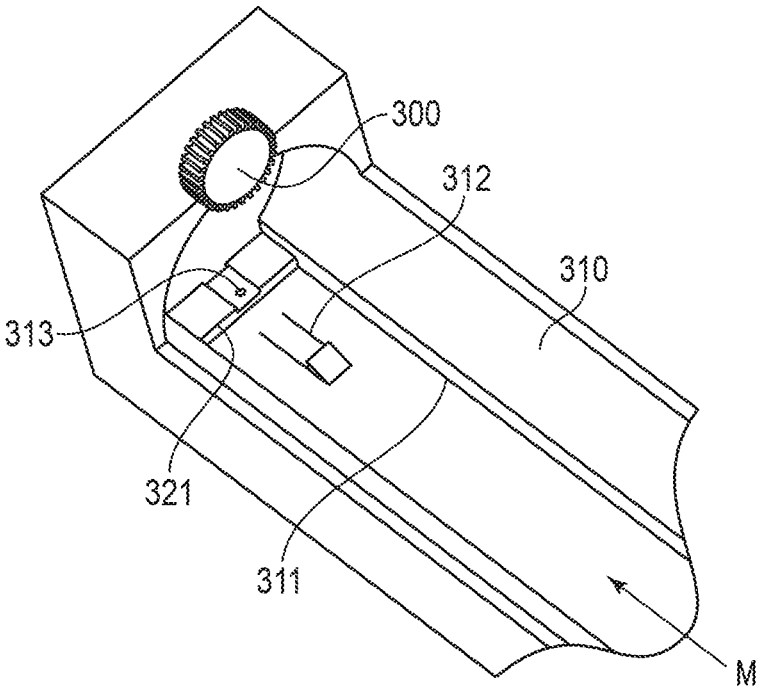
FIG. 4B is a perspective view of the mount section.

The mount section 310 will be described with reference to FIGS. 4A and 4B. FIG. 4A is a partial front view of the mount section 310, as viewed from a near side in a direction of mounting the toner container T. FIG. 4B is a perspective view useful in explaining the inside of the mount section 310. Note that the toner container T is mounted on the mount section 310 in a direction indicated by an arrow M as shown in FIG. 4B. This direction indicated by the arrow M is substantially parallel to the rotational axis of the photosensitive drum 1 of the image forming apparatus 200. Further, a direction of removing the toner container T from the mount section 310 is a direction opposite to the direction M. The toner container T is rotatably mounted on the mount section 310.

The mount section 310 includes a drive gear 300, a rotation restriction section 311 that restricts a cap portion 222 (see FIGS. 5A to 5C) of the toner container T from rotating in accordance with rotation of the toner container T, a bottom portion 321, and a restriction portion 312. The restriction portion 312 is engaged with the cap portion 222 of the toner container T to thereby restrict the cap portion 222 from moving in the rotational axis direction. The drive gear 300 transmits a rotational drive force from the driving motor 604 to the toner container T mounted on the mount section 310.

The bottom portion 321 is formed with a reception port 313 which communicates with a discharge port 211 (see FIGS. 5B and 5C) of the toner container T and receives toner discharged from the toner container T. Toner discharged from the discharge port 211 of the toner container T is supplied through the reception port 313 to the developing device 100. The reception port 313 has the same diameter as that of the discharge port 211 and is set to approximately 2 [mm], for example.

Figure 5A:
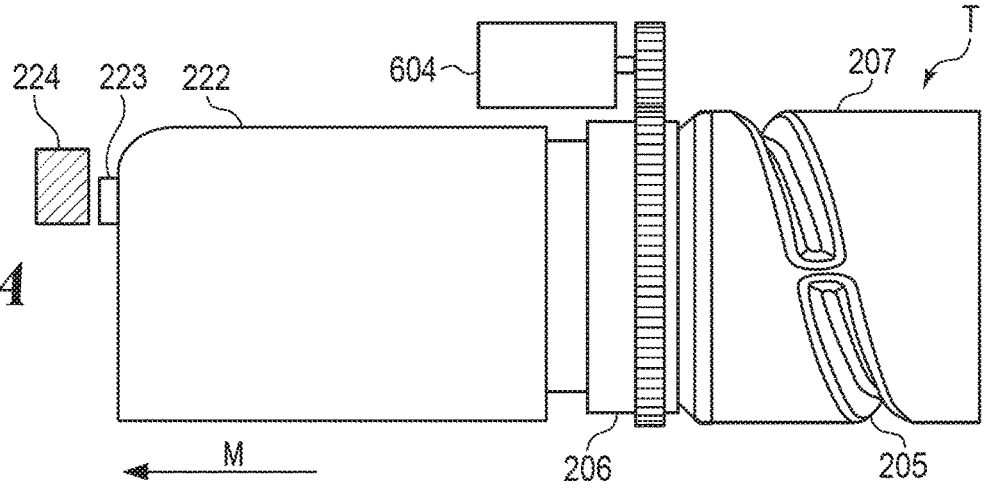
FIG. 5A is a view showing the appearance of one toner container.
Figure 5B:
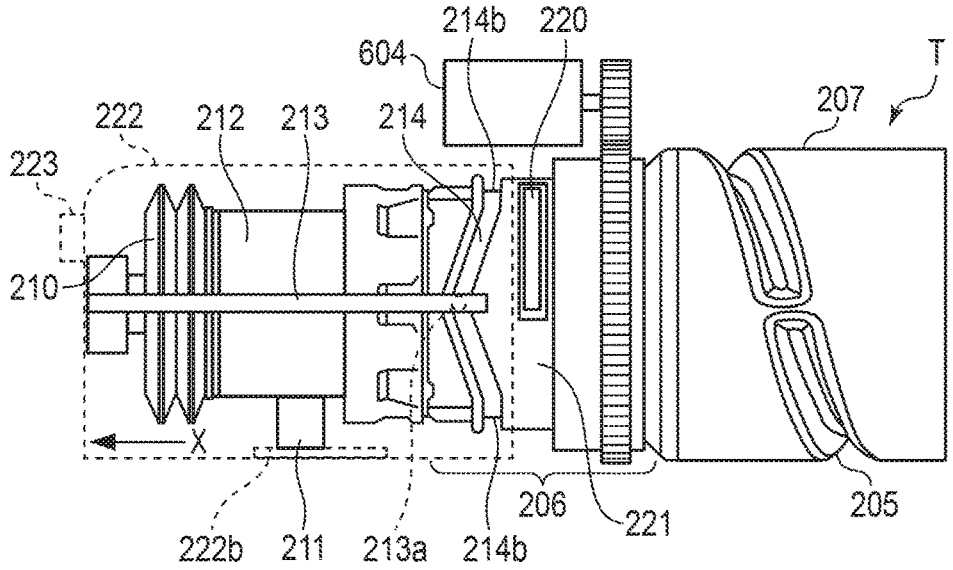
FIGS. 5B and 5C are views each showing an internal structure of the toner container shown in FIG. 5A.
Figure 5C:
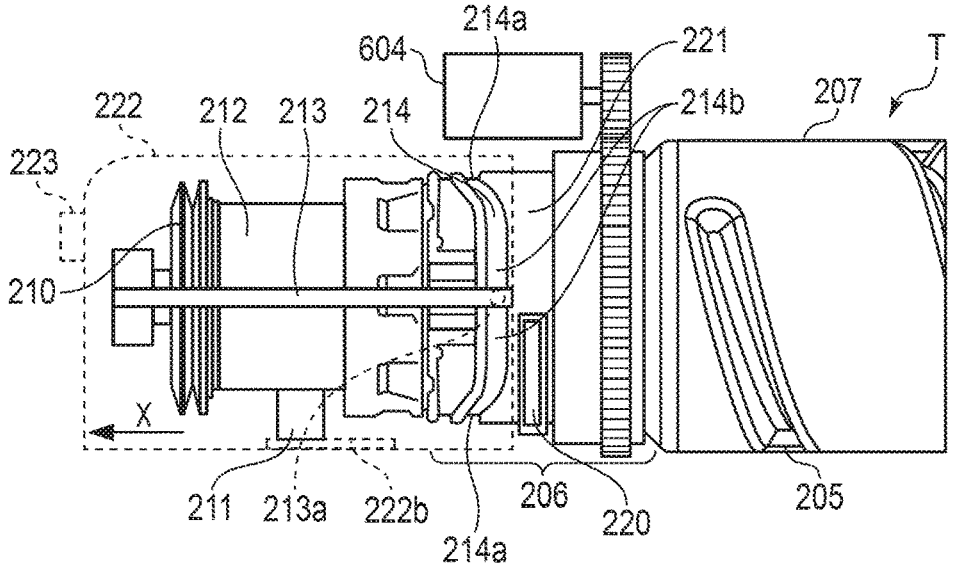

FIG. 5A is a view showing the appearance of one toner container T. FIGS. 5B and 5C are views each showing an internal structure of the toner container T. The toner containers T have the same basic configuration, and hence one of the toner containers T will be described. The toner container T has the cap portion 222. FIGS. 5B and 5C show a state in which the cap portion 222 is removed. The toner container T has a pump portion 210 which is expanded and contracted. FIG. 5B shows a state in which the pump portion 210 is expanded to the maximum, and FIG. 5C shows a state in which the pump portion 210 is contracted to the maximum.

The toner container T includes a container portion 207 for containing toner, a drive transmission section 206 to which a rotational drive force is transmitted from the driving motor 604, and a discharge portion 212. The discharge portion 212 has the discharge port 211 through which toner is discharged. The toner container T includes reciprocation members 213 that expand and contract the pump portion 210 for discharging toner from the discharge port 211. The drive transmission section 206 has protruding portions 220 and a cam groove 214. The cam groove 214 is formed around the circumference of the drive transmission section 206 in a rotational direction in which the drive transmission section 206 of the toner container T is rotated. The container portion 207 is connected to the drive transmission section 206. The cam groove 214 and the protruding portions 220 are rotated in unison with the drive transmission section 206. The drive motor 604 transmits the rotational drive force to the drive transmission section 206 of the toner container T via the drive gear 300, whereby the drive transmission section 206 and the container portion 207 are rotated. The inner peripheral surface of the container portion 207 has a protruding portion 205 formed thereon which protrudes inward in a spiral shape. The protruding portion 205 conveys toner in the container portion 207 toward the discharge port 211 in accordance with rotation of the container portion 207. The outer peripheral portion 221 is part of the drive transmission section 206, which is circumferentially adjacent to the protruding portions 220 and is an area lower than the protruding portions 220.

The toner container T is used in a state mounted on the mount section 310 (see FIG. 4B). The cap portion 222 is restricted by the mount section 310 from rotation, and hence even when the drive transmission section 206 is rotated, the cap portion 222 is not rotated. The discharge port 211, the pump portion 210, and the reciprocation members 213 are also restricted from rotating even when the drive transmission section 206 is rotated, similar to the cap portion 222. The cap portion 222 has rotation restriction grooves 215 (see FIGS. 6A and 6B) formed in an inner peripheral surface thereof. The reciprocation members 213 and the rotation restriction grooves 215 are engaged with each other, whereby the rotation restriction grooves 215 restrict the reciprocation members 213 from being rotated by rotation of the drive transmission section 206. The reciprocation members 213 are connected to the pump portion 210, and a lug portion 213*a* formed on each reciprocation member 213 is engaged with the cam groove 214 of the drive transmission section 206. With this, the lug portions 213*a* are moved along the cam groove 214 in a state in which the reciprocation members 213 are restricted from rotating in accordance with rotation of the drive transmission section 206. Therefore, the reciprocation members 213 axially reciprocate along the rotational axis of the drive transmission section 206, i.e. in a direction indicated by an arrow X and a direction opposite thereto, in accordance with rotation of the drive transmission section 206.

The pump portion 210 is a bellows-type pump formed of resin, the volume of which is variable in accordance with the expansion and contraction operation. The pump portion 210 has mountain ridge-like folded portions and valley-like folded portions arranged in an alternately repeated manner along a longitudinal direction of the toner container T. Since the reciprocation members 213 are connected to the pump portion 210, the pump portion 210 alternately repeats expansion and contraction in accordance with reciprocation of the reciprocation members 213. When the reciprocation members 213 are moved in the direction indicated by the arrow X, the pump portion 210 is expanded. The expansion of the pump portion 210 lowers the inner pressure of the toner container T, so that air is sucked from the discharge port 211 to loosen toner in the discharge section 212. Next, when the reciprocation members 213 are moved in the direction opposite to the direction indicated by the arrow X, the pump portion 210 is contracted. The contraction of the pump portion 210 increases the inner pressure of the toner container T, so that toner accumulated on the discharge port 211 is supplied from the discharge port 211 into the developing device 100.

The memory 223 which records information on the toner container T is affixed to the cap portion 222. The CPU 701 communicates with the memory 223 via the reading section 224, and reads replenishment information of the toner container T. The replenishment information includes identification information of the toner container T. For example, the CPU 701 performs identification processing for uniquely identifying the toner container T based on the identification information stored in the memory 223. Further, the replenishment information includes a value of the number of times of rotation (strictly, half rotation) of the toner container T. The CPU 701 updates the information on the number of times of rotation of the toner container T, stored in the memory 223, whenever the toner container T turns half rotation. Further, the cap portion 222 is provided with a seal member 222*b* for sealing the discharge port 211. When the discharge port 211 is sealed by the seal member 222*b*, it is possible to prevent toner in the toner container T from leaking from the discharge port 211. The user removes the seal member 222*b* before mounting the toner container T on the mount section 310, whereby the discharge port 211 of the toner container T is opened.

The toner container T performs the replenishment operation twice per one rotation of the toner container T. One toner replenishment operation starts from a state in which the pump portion 210 is contracted to the maximum, and ends in a state in which the pump portion 210 is contracted to the maximum after being expanded and then contracted. The cam groove 214 is formed with two peak areas 214*a* and two valley areas 214*b* in the order of valley, peak, valley, and peak in a direction of formation of the cam groove 214. When the peak areas 214*a* of the cam groove 214 are engaged with the lug portions 213*a* of the reciprocation members 213, the pump portion 210 is in the maximum expanded state (see FIG. 5B). When the valley areas 214*b* of the cam groove 214 are engaged with the lug portions 213*a* of the reciprocation members 213, the pump portion 210 is in the maximum contracted state (see FIG. 5C).

Figure 6A:
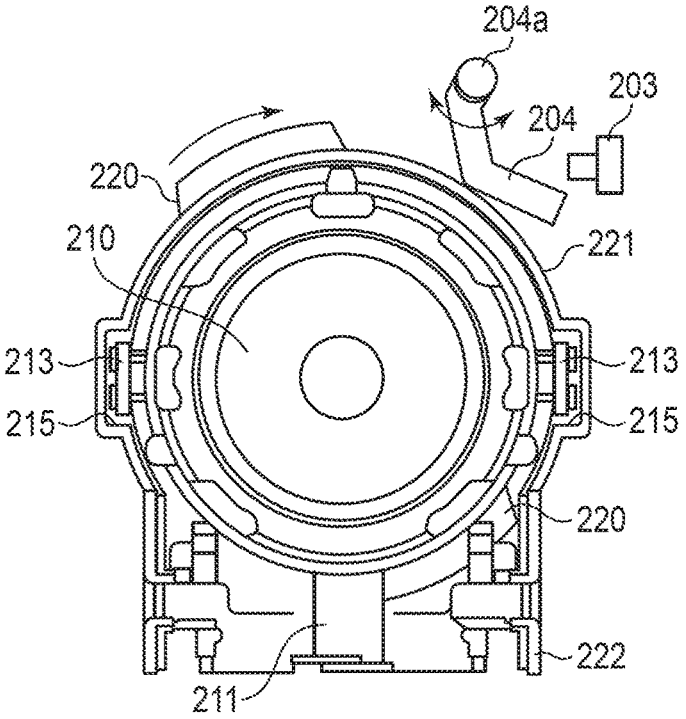
FIGS. 6A and 6B are views of the toner container, as viewed from the side of the mount section.
Figure 6B:
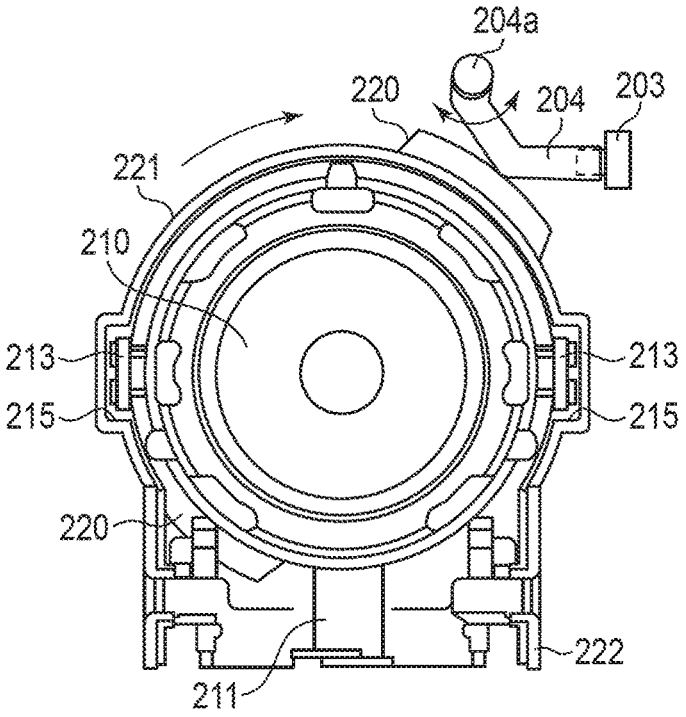

The rotation sensor 203 will be described with reference to FIGS. 6A and 6B. FIGS. 6A and 6B are views of the toner container T, as viewed from the side of the mount section 310. FIGS. 6A and 6B show states in which the output detection section 705 outputs the signal at the low level and the signal at the high level, respectively.

The rotation sensor 203 is the optical sensor having the light emission section and the light receiving section, as mentioned above. A flag 204 is brought into contact with the drive transmission section 206 of the toner container T by its own weight. The flag 204 is disposed at a location overlapping with an area in which the protruding portion 220 is formed, in the axial direction of the drive transmission section 206. As the drive transmission section 206 is rotated, the flag 204 is pushed by the protruding portion 220 of the drive transmission section 206 and rotated about a rotation axle 204*a* to thereby shield light from the light emission section.

FIG. 6A shows a state of the flag 204 in which it is brought into contact with the outer peripheral portion 221 in the rotational direction (clockwise direction as viewed in FIG. 6A) of the drive transmission section 206. In this state, the flag 204 is not positioned between the light emission section and the light receiving section, and hence the light receiving section can receive light emitted from the light emission section. In the present embodiment, unless the flag 204 is positioned between the light emission section and the light receiving section, the amount of light received by the light receiving section is not smaller than the threshold value. Therefore, it is possible to detect using the rotation sensor 203 whether the flag 204 is in contact with either of the protruding portions 220 or the outer peripheral portion 221. This enables the rotation sensor 203 to detect the rotational position of the toner container T.

More specifically, the output detection section 705 (FIG. 2) outputs the signal at the low level (logical 'L') if the amount of light received by the light receiving section is not smaller than the threshold value. That is, during time in which the flag 204 is in contact with the outer peripheral portion 221 as shown in FIG. 6A, the output detection section 705 outputs the signal at the low level (logical 'L') to the CPU 701. On the other hand, in a case where the flag 204 is in contact with the protruding portion 220 as shown in FIG. 6B, since the flag 204 is positioned between the light emission section and the light receiving section, the light receiving section cannot receive light emitted from the light emission section. Therefore, the amount of light received by the light receiving section is smaller than the threshold value, and the output detection section 705 outputs the signal at the high level (logical 'H'). That is, the output detection section 705 outputs the signal at the high level (logical 'H') to the CPU 701 during time in which the flag 204 is in contact with the protruding portion 220.

After the signal output from the output detection section 705 changes from the high level to the low level, the pump portion 210 of the toner container T starts to expand. During time in which the signal output from the output detection section 705 remains at the low level, the pump portion 210 is expanded to the maximum and then starts to contract. Then, the pump portion 210 is shifted to the maximum contracted state before the signal output from the output detection section 705 changes from the low level to the high level. That is, the pump portion 210 is contracted to supply toner to the developing device 100 during time in which the flag 204 is in contact with the outer peripheral portion 221.

Figure 7A:
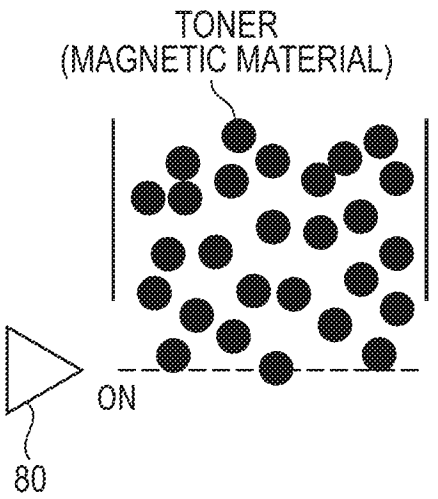
FIGS. 7A to 7C are diagrams useful in explaining how moving toner is detected by a density sensor.
Figure 7B:
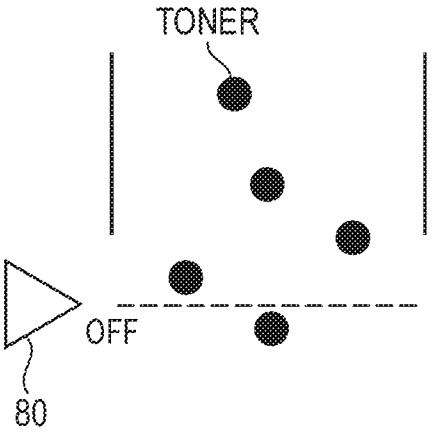
Figure 7C:
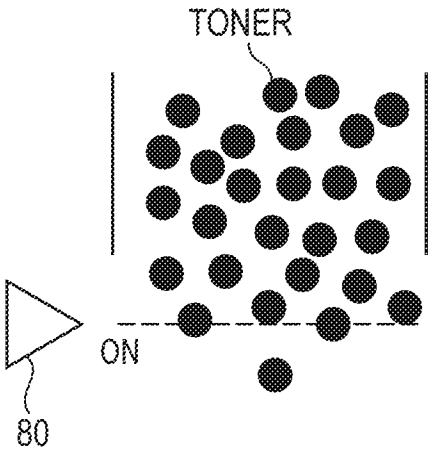

FIGS. 7A to 7C are diagrams useful in explaining how moving toner is detected by the density sensor 80. The density sensor 80 is a magnetic permeability sensor. The density sensor 80 outputs an ON-state signal in a case where toner including a magnetic material is detected as shown in FIGS. 7A and 7C, and outputs an OFF-state signal in a case where the toner is not detected as shown in FIG. 7B. That is, the density sensor 80 outputs a signal indicative of whether or not toner is detected.

In the present embodiment, the CPU 701 determines whether or not toner is present in the developing device 100 by monitoring the signal output from the density sensor 80 at intervals of 100 msec. If toner is not detected by the density sensor 80 continuously a predetermined number of times (i.e. if the OFF state is detected from the signal output from the density sensor 80 the predetermined number of times), the CPU 701 determines that toner in the developing device 100 has run out. Note that the above-mentioned toner presence/absence detection processing is an example, but any other suitable processing may be employed. Further, presence or absence of toner may be detected by applying a piezo sensor to the density sensor.

Figure 8:
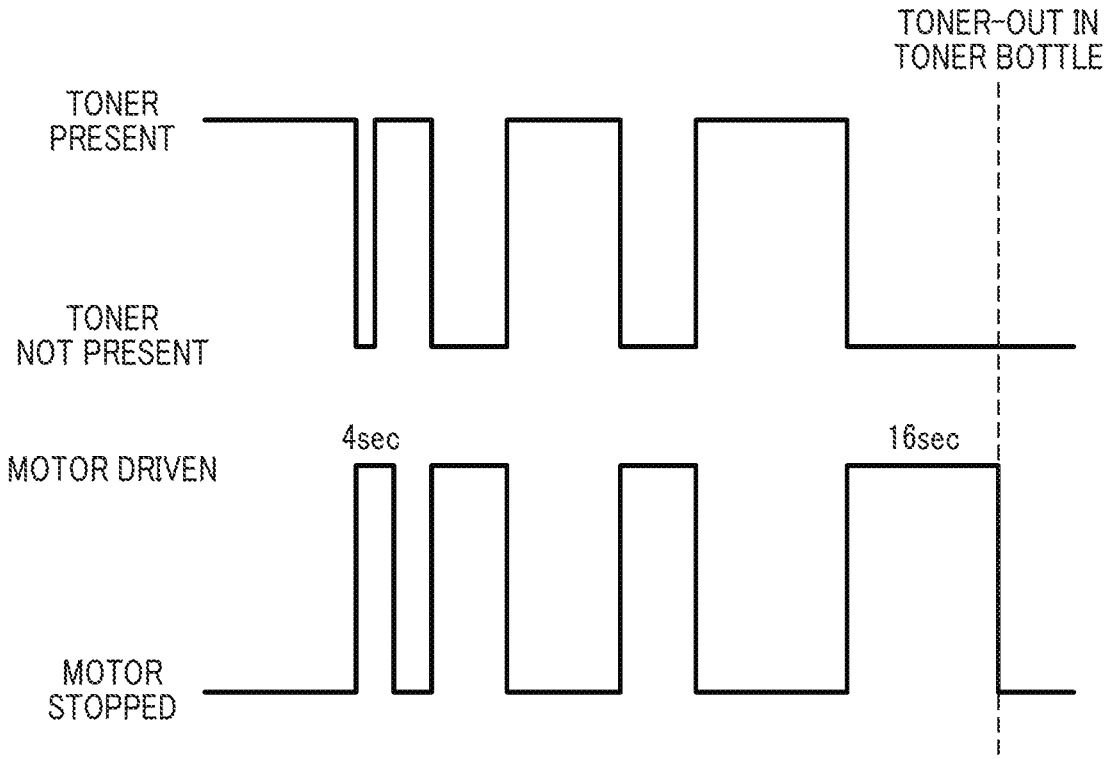
FIG. 8 is a timing diagram useful in explaining toner-out determination.

A sequence for determining that toner in the toner container T has run out will be described with reference to FIG. 8. FIG. 8 is a timing diagram of toner-out determination. As mentioned above, toner corresponding to image data is discharged from the developing device 100 during image formation. Then, as the toner continues to be discharged from the developing device 100, eventually, it is determined by the density sensor 80 that toner in the developing device 100 has run out. The state in which it is determined by the density sensor 80 that toner in the developing device 100 has run out means a state in which the amount of toner in the developing device 100 has become smaller than a second predetermined amount. In the following description, this state is expressed as toner in the developing device 100 has run out (the developing device 100 has become empty) for convenience of explanation. When it is determined that toner in the developing device 100 has run out (the developing device 100 has become empty), the CPU 701 controls the driving motor 604 to rotate the toner container T. By doing this, toner is replenished from the toner container T to the developing device 100, and hence it is soon determined by the density sensor 80 that toner is present in the developing device 100.

That is, the CPU 701 controls the driving motor 604 so as to cause the developing device 100 to keep containing a predetermined amount or more of toner. In the illustrated example in FIG. 8, the CPU 701 drives the driving motor 604 for four seconds, whereby the result of detection of toner in the developing device 100 by the density sensor 80 changes from "toner out" to "toner present". Further, when the amount of toner in the toner container T becomes smaller than a first predetermined amount, toner is no longer replenished to the developing device 100 even though the driving motor 604 is driven. Then, even when the driving motor 604 continues to be driven for sixteen seconds, it is continuously determined by the density sensor 80 that toner in the developing device 100 has run out. In this case, the CPU 701 determines that toner in the toner container T has run out (amount of remaining toner is smaller than the first predetermined amount).

Figure 9:
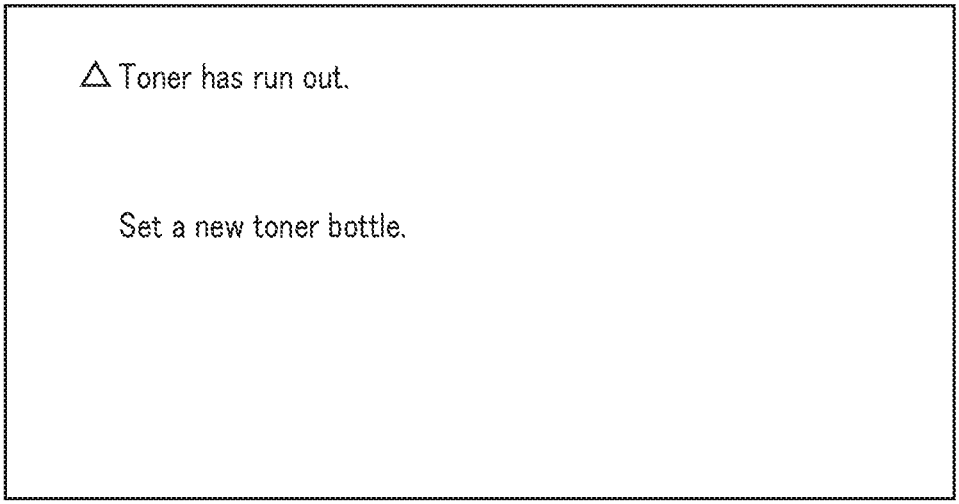
FIG. 9 is a view of an example of a replacement screen.

FIG. 9 is a view of an example of a replacement screen. This replacement screen is displayed on the liquid crystal display 707 of the console section 706 when it continues to be determined for a predetermined time period (16 seconds in the present embodiment) that toner in the developing device 100 has run out and hence it is determined that toner in the toner container T has run out. The replacement screen displays a message for notifying a user that toner in the toner container T has run out and it is necessary to replace the toner container T with a new toner container T.

According to an instruction on the replacement screen, the user removes the toner container T, and mounts a new toner container T on the mount section 310 in place of the removed toner container T. After detecting removal of the toner container T, when the CPU 701 detects that the new toner container T has been mounted, the CPU 701 closes the replacement screen. In the case where the toner container T has been replaced, a home screen is displayed on the console section 706.

Note that the developing device 100 is empty immediately after the toner container T has been replaced, and hence first, the CPU 701 controls the driving motor 604 to execute toner replenishment from the toner container T to the developing device 100. Then, when it is determined by the density sensor 80 that toner is present in the developing device 100, the image forming apparatus 200 is enabled to perform the image forming operation.

The driving motor 604 is the DC motor as mentioned above. In a case where the driving motor 604 drives the toner container T for rotation, the rotational speed of the toner container T varies with the weight of the toner container T. AS toner is supplied from the toner container T to the developing device 100, the amount of toner stored in the toner container T decreases, and hence the weight of the toner container T decreases. If the driving motor 604 rotates the toner container T based on a fixed PWM value in spite of the decrease in the amount of toner in the toner container T, the rotational speed of the toner container T becomes higher than the target rotational speed. It is known by experiment that the amount (replenished amount) of toner replenished from the toner container T to the developing device 100 assumes a value dependent on a rate of change of the inner pressure of the toner container T. More specifically, in a case where the rotational speed of the toner container T becomes higher than the target rotational speed due to decrease in the weight of the toner container T, the moving speed of the reciprocation members 213 accordingly increases, which increases a rate of contraction of the pump portion 210, and hence the rate of change of the inner pressure of the toner container T increases, so that the replenishment amount of the toner container T becomes larger than the target replenishment amount.

Further, according to the experiment, as the rotational speed of the toner container T is higher, the amount of toner discharged from the toner container T per one replenishment operation becomes larger. More specifically, the amount of discharged toner from the toner container T at a rotational speed of 120 rpm increases by as much as 40% with respect to the amount of discharged toner from the same at a rotational speed of 30 rpm. In the configuration in which toner is directly replenished from the toner container T to the developing device 100, if the amount of discharged toner changes by 40%, the density of a print can be changed.

In the present embodiment, one toner replenishment operation starts from the state in which the pump portion 210 is contracted to the maximum, and ends in the state in which the pump portion 210 is contracted to the maximum after being expanded. The toner replenishment amount is influenced by the rotational speed of the toner container T when the pump portion 210 is contracted. To cope with this, the position of the toner container T at which the DC motor starts rotation (i.e. at which the preceding toner replenishment is stopped) is designed such that the rotational speed of the DC motor is stable at the target rotational speed before the pump portion 210 starts to contract.

Further, in the present embodiment, the change in the rotational speed of the toner container T due to a change in the weight of the toner container T is reduced by feedback-controlling the rotational speed of the toner container T. To perform the feedback control with high accuracy, it is important that the controller 700 measures the rotational speed of the toner container T with high accuracy. The DC motor requires some time to reach the target rotational speed after starting the rotation. Further, the DC motor also requires some time to stop the rotation after the ENB signal is stopped. Therefore, it is necessary to detect the timing at which the DC motor has become stable at the target rotational speed, and measure the rotational speed. As described above, the DC motor of the present embodiment is designed such that it becomes stable at the target rotational speed before the pump portion 210 starts to contract. Therefore, the controller 700 measures the rotational speed of the toner container T at the timing at which the pump portion 210 is contracted.

Figure 10:
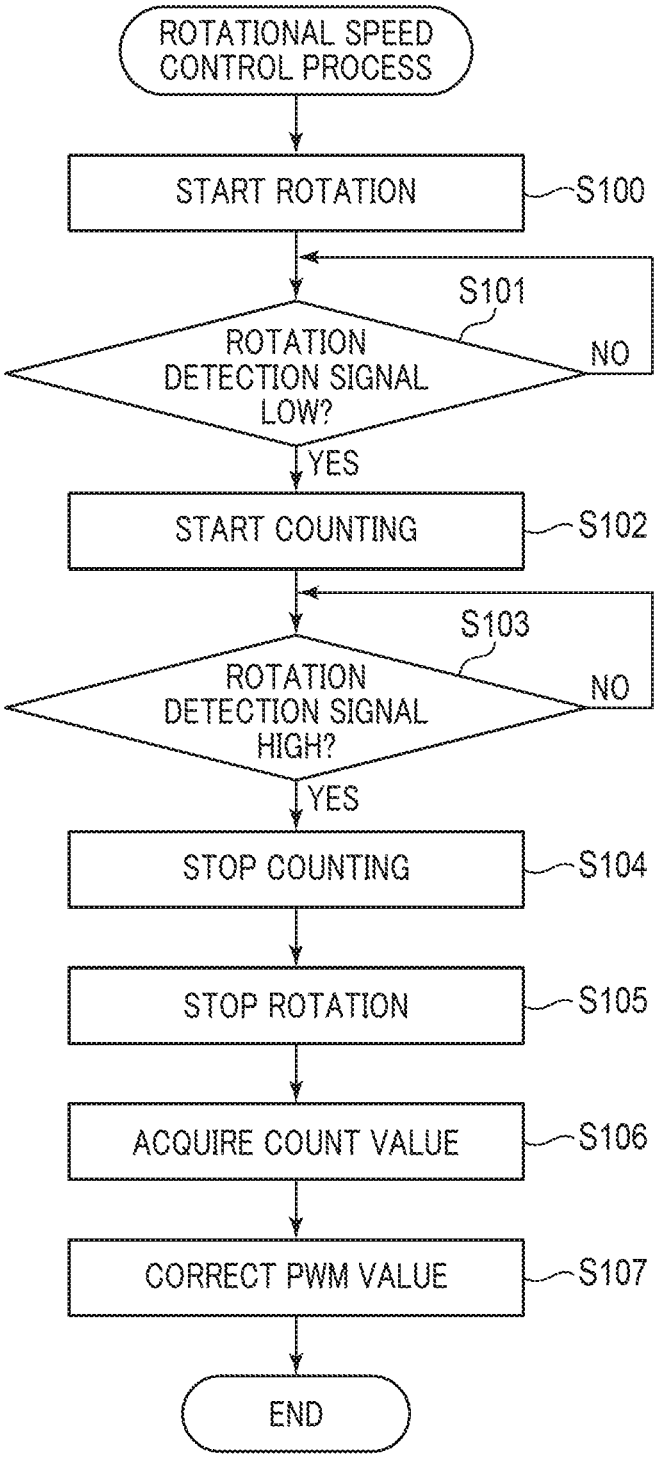
FIG. 10 is a flowchart of a rotational speed control process.

The following description will be given of a rotational speed control process performed by the CPU 701, for controlling the driving of the driving motor 604 for rotation such that the rotational speed of the driving motor 604 becomes equal to the target speed. FIG. 10 is a flowchart of the rotational speed control process. The rotational speed control process in FIG. 10 is realized by the CPU 701 that loads an associated program stored in the ROM 702 into the RAM 703 and executes the same.

When replenishing toner from the toner container T to the developing device 100, the CPU 701 performs the rotational speed control process in FIG. 10. That is, the CPU 701 performs the rotational speed control process in FIG. 10 based on a toner replenishment instruction. Note that the CPU 701 provides the toner replenishment instruction when the amount of toner in the developing device 100, detected by the density sensor 80, has become smaller than a third predetermined amount.

First, in a step S100, the CPU 701 controls the driving motor 604 to rotate the toner container T. More specifically, the CPU 701 sets a PWM value stored in the RAM 703 to the motor driving section 704, and outputs an ENB signal to the motor driving section 704. Upon receipt of the ENB signal, the driving motor 604 starts to drive the toner container T for rotation. If no PWM value is stored in the RAM 703, the CPU 701 sets e.g. a default value as the PWM value.

After the driving of the driving motor 604 for rotation is started, the CPU 701 waits in a step S101 until the signal at the low level (logical 'L') is output from the output detection section 705. That is, the CPU 701 waits until the flag 204 is brought into contact with the outer peripheral portion 221. If the signal at the low level is output from the output detection section 705 in the step S101, in a step S102, the CPU 701 starts counting of a predetermined clock signal. Then, in a step S103, the CPU 701 waits until the signal at the high level (logical 'H') is output from the output detection section 705. That is, the CPU 701 waits until the flag 204 is brought into contact with the protruding portion 220. When the signal output from the output detection section 705 changes from the low level to the high level, in a step S104, the CPU 701 stops counting. That is, in the steps S101 to S104, the CPU 701 measures the time period during which the signal at the low level is output from the output detection section 705. Here, the time period during which the signal at the low level is output from the output detection section 705 corresponds to a time period during which the flag 204 is in contact with the outer peripheral portion 221 in accordance with rotation of the toner container T.

When the signal output from the output detection section 705 changes from the low level to the high level, the CPU 701 determines that the replenishment operation has been performed once (for one block). As a result, in the following step S105, the CPU 701 stops rotation of the toner container T. The CPU 701 stops the ENB signal input to the motor driving section 704 to stop driving the toner container T for rotation.

Next, in a step S106, the CPU 701 acquires a count value Tn stored in the RAM 703. The count value Tn corresponds to a time period during which the outer peripheral portion 221 is detected by the rotation sensor 203 during rotation of the toner container T. Further, the time period in which the outer peripheral portion 221 is detected by the rotation sensor 203 corresponds to a time period during which the pump portion 210 is expanded and contracted. This corresponds to a time period over which the replenishment operation for replenishing toner from the toner container T to the developing device 100 has been performed.

Next, in a step S107, the CPU 701 corrects the PWM value stored in the RAM 703 based on the count value Tn, followed by terminating the rotational speed control process. The CPU 701 corrects the PWM value in the following manner: First, the CPU 701 calculates a rotational speed V(n) of the current replenishment operation from the count value Tn. The count value Tn indicates a time period during which the flag 204 is in contact with the outer peripheral portion 221. Since the length of the circumference of the outer peripheral portion 221 is already known, it is possible to calculate the rotational speed V(n) of the current replenishment operation based on the count value Tn. Next, the CPU 701 calculates a value D(n+1) as the corrected PWM value based on the following equation (1):

$$D(n+1)=D(n)+Ki*(Vtgt-V(n)) \quad (1)$$

In this equation, D(n) represents the current PWM value (the PWM value set in the step S100), Ki represents a predetermined proportionality constant, and Vtgt represents the target rotational speed. The value D(n+1) as the corrected PWM value is used for the next replenishment operation. That is, the CPU 701 measures the time period during which the pump portion 201 is expanded and contracted, and controls the rotational speed of the toner container T driven for rotation next time, based on a result of the measurement.

The timing at which the flag 204 is pushed up by the protruding portion 220 corresponds to the timing at which the contraction of the pump portion 210 ends. That is, the controller 700 uses a result of detection of a leading end of the protruding portion 220 in the rotational direction, as an index indicating both of the end of the measurement time of the rotational speed and the end of the replenishment operation. This makes it possible to simplify the configuration of the protruding portion 220 provided on the drive transmission section 206 and also simplify the control of the CPU 701. Thus, the CPU 701 corrects the PWM value for controlling the rotational speed of the driving motor 604 based on the time period during which the outer peripheral portion 221 of the toner container T is detected by the rotation sensor 203. With this, the rotational speed of the toner container T is controlled to the target rotational speed. As a result, it is possible to stabilize the amount of toner discharged from the toner container T.

Figure 11:
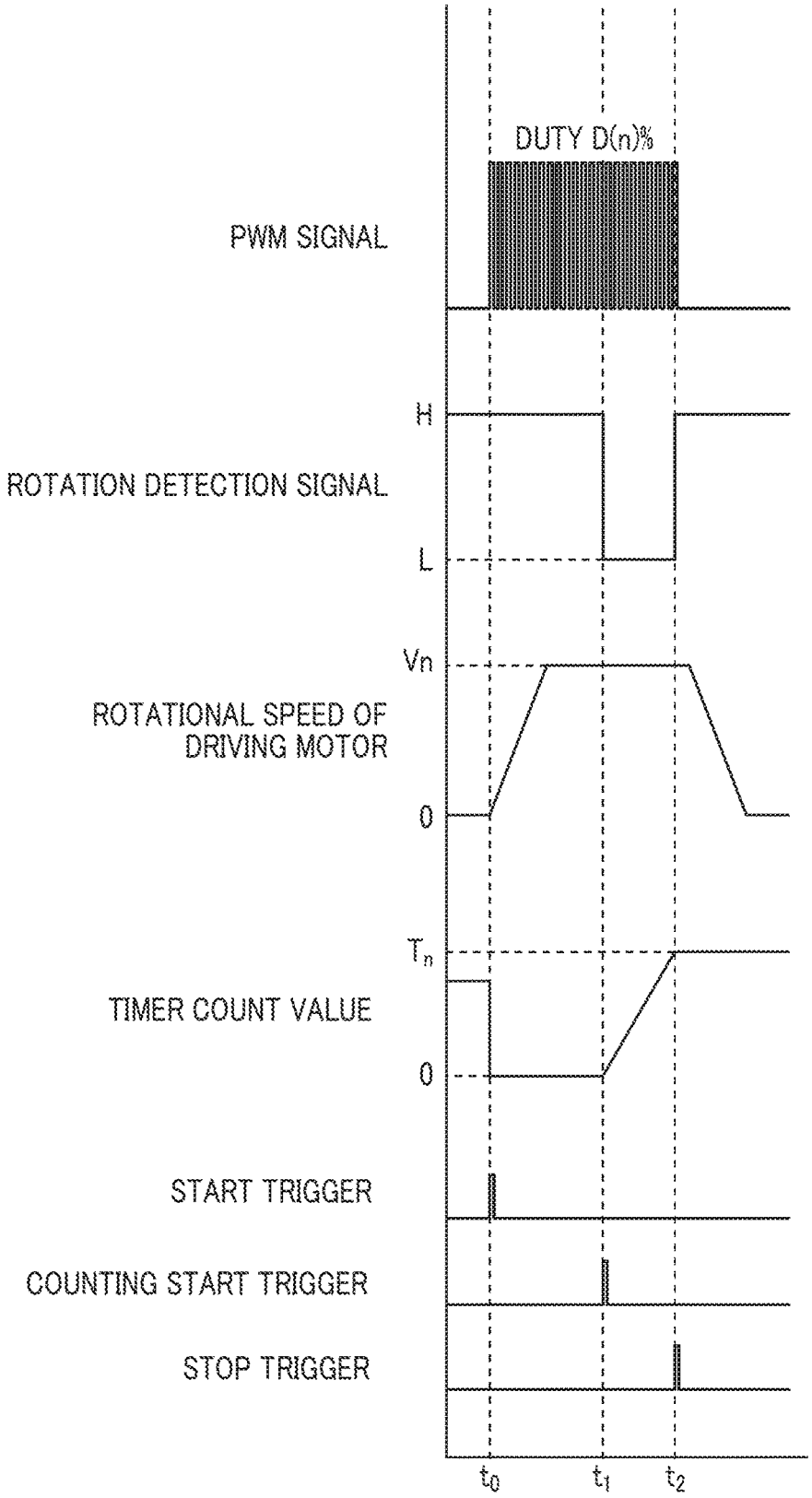
FIG. 11 is a timing diagram of various signals.

FIG. 11 is a timing diagram of the PWM value, the output signal from the output detection section 705 (rotation detection signal), the rotational speed of the drive motor 604, the count value Tn, a start signal for starting the replenishment operation, a count start signal indicative of the start of counting, and a stop signal for terminating the replenishment operation.

In a case where toner is replenished from the toner container T to the developing device 100 at time t0, the CPU 701 outputs the start signal (start trigger) at time t0. When the start signal is output, the motor driving section 704 starts to control the time period over which electric power is supplied to the driving motor 604 based on the PWM value (D(n) % in FIG. 11). Further, the CPU 701 sets the count value of the timer to 0 when the start signal is output at time t0. After the motor driving section 704 has started to drive the driving motor 604 for rotation, the rotational speed of the driving motor 604 is increased. At this time, the output detection section 705 is outputting the signal at the high level. In other words, the pump portion 210 of the toner container T is in the state contracted to the maximum.

Then, the signal output from the output detection section 705 changes from the high level to the low level at time t1. When the signal output from the output detection section 705 changes from the high level to the low level, the CPU 701 outputs the count start signal. With this, the count value Tn starts to increase. The pump portion 210 is expanded and contracted during time in which the output detection section 705 is outputting the signal at the low level.

Then, the signal output from the output detection section 705 changes from the low level to the high level at time t2. When the signal output from the output detection section 705 changes from the low level to the high level, the CPU 701 outputs the stop signal. With this, the increase in the count value Tn is stopped, and the motor driving section 704 stops driving the driving motor 604 for rotation. At this time, the pump portion 210 is contracted to the maximum. The CPU 701 controls the motor driving section 704 to stop driving the driving motor 604 for rotation, whereby the driving of the toner container T for rotation is stopped before the pump portion 210 starts to expand.

Here, if the toner container T has been mounted on the mount section 310 at a predetermined rotational angle, the flag 204 is pushed up by the protruding portion 220 (predetermined portion). That is, in a case where the user has mounted the toner container T on the mount section 310 at the predetermined angle, the signal output from the output detection section 705 changes from the low level to the high level. Therefore, the CPU 701 can determine, based on the output from the output detection section 705, whether or not the toner container T has been mounted on the mount section 310 of the image forming apparatus 200 at the predetermined rotational angle. If the signal output from the output detection section 705 is at the high level, the CPU 701 determines that the toner container T has been mounted on the mount section 310, whereas if the signal output from the output detection section 705 is the signal at the low level, the CPU 701 determines that the toner container T has not been mounted on the mount section 310.

Figure 12A:
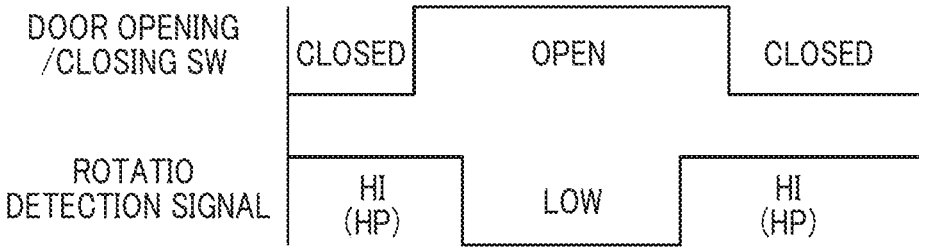
FIGS. 12A and 12B are diagrams useful in explaining signal output timings of a door opening/closing SW and an output detection section.
Figure 12B:
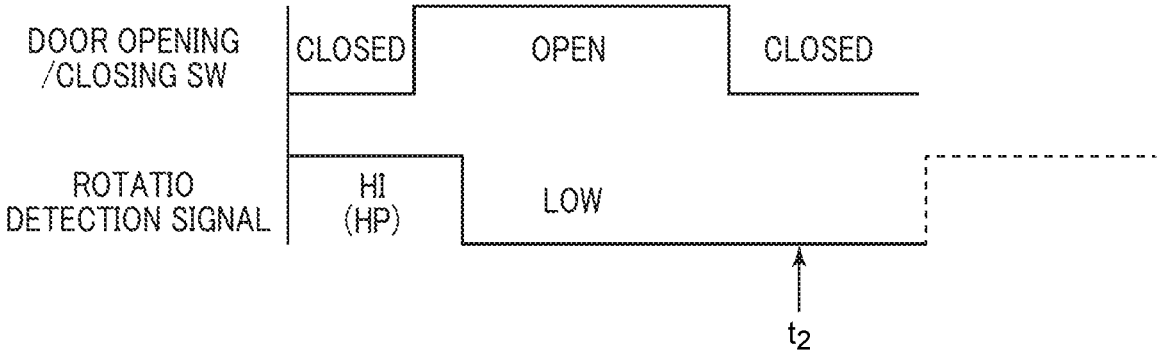

FIGS. 12A and 12B are diagrams each showing the timings at which signals are output from the door opening/closing SW 27 and the output detection section 705. The operation for determining whether or not the toner container T has been mounted on the mount section 310 of the image forming apparatus 200 will be described with reference to FIGS. 12A and 12B.

In a case where the toner replenishment operation is not performed, the toner container T is stationary at a home position (HP). At this time, the flag 204 is pushed up by the protruding portion 220 of the toner container T (see FIG. 6B). Therefore, the output detection section 705 outputs the signal at the high level. Note that if the door 26 is not open, the door opening/closing SW 27 outputs the signal at the low level.

When replacing the toner container T, the user opens the door 26. If the door 26 is in the opened state, the door opening/closing SW 27 outputs the signal at the high level. Then, in accordance with removal of the toner container T from the mount section 310 by the user, the output detection section 705 outputs the signal at the low level. This is because the flag 204 is retracts from the position between the light emission section and the light receiving section by its own weight (see FIG. 6A). Since the flag 204 is moved to a position where the flag 204 does not block the path of light, the output detection section 705 outputs the signal at the low level.

After that, when the user mounts the toner container T on the mount section 310, the output detection section 705 outputs the signal at the high level. Then, when the user closes the door 26, the door opening/closing SW 27 outputs the signal at the low level. In a case where the signal output from the output detection section 705 changes from the high level to the low level, and further changes from the low level to the high level during time in which the door opening/closing SW 27 is outputting the signal at the high level, the CPU 701 determines that toner container T removal has been once performed and then toner container T mounting has been performed.

However, as shown in FIG. 12B, there is a possibility that the door 26 is closed in a state in which the output detection section 705 is outputting the signal at the low level. For example, in a case where the door 26 is closed without mounting the toner container T on the mount section 310, the output signals are in the state shown in FIG. 12B. Also in a case where the toner container T has been mounted on the mount section 310 but the toner container T is at a rotational angle different from the predetermined (proper) rotational angle, the output signals are in the state as shown in FIG. 12B. In such a case as shown in FIG. 12B (in the case where the signal output from the door opening/closing SW 27 changes from the high level to the low level in the state in which the output detection section 705 is outputting the signal at the low level), the CPU 701 cannot determine whether or not the toner container T has been mounted on the mount section 310.

To solve this problem, the CPU 701 causes the driving motor 604 to rotate the toner container T so as to determine whether or not the toner container T has been mounted. If the toner container T has been mounted on the mount section 310, the protruding portion 220 of the rotating toner container T is eventually detected by the rotation sensor 203, whereupon the signal output from the output detection section 705 changes from the low level to the high level. That is, the CPU 701 causes the driving motor 604 to rotate the toner container T, and when the signal output from the output detection section 705 changes from the low level to the high level, the CPU 701 determines that the toner container T has been mounted on the mount section 310. However, even when the toner container T is rotated, if the signal output from the output detection section 705 remains unchanged from the signal at the low level, the CPU 701 determines that the toner container T has not been mounted on the mount section 310.

FIGS. 13A to 13D are views each showing an example of a screen displayed on the liquid crystal display 707. First, FIG. 13A shows a first warning screen displayed when the toner container T has been removed from the mount section 310 in the state in which the amount of remaining toner in the toner container T is not smaller than the first predetermined amount (the replacement condition is not satisfied). The first warning screen displays information associated with color of toner in the removed toner container T and a message prompting the user to remount the removed toner container T on the mount section 310. This makes it possible to prevent the user from discarding, by mistake, the toner container T which is not required to be replaced. The first warning screen corresponds to a guidance for prompting the user to remount the toner container T which has been removed from the mount section 310. Not that if the amount of toner remaining in the toner container T is smaller than the first predetermined amount, the first warning screen is not displayed.

Note that if the amount of remaining toner in the toner container T is not smaller than the first predetermined amount, this means that the toner container T does not satisfy the replacement condition. If the amount of remaining toner in the toner container T is smaller than the first predetermined amount, the toner container T satisfies the replacement condition. Although satisfaction of the replacement condition is determined based on the amount of remaining toner, the replacement condition may be defined by another element or may be defined by including another element.

FIG. 13B shows a second warning screen displayed on the liquid crystal display 707 when the toner container T has been replaced by another toner container (not shown, hereafter referred to as the toner container T') in a state in which the amount of remaining toner in the toner container T is not smaller than the first predetermined amount (the replacement condition is not satisfied). The second warning screen displays information associated with color of toner in the toner container T removed in the state in which the amount of remaining toner is not smaller than the first predetermined amount and a message prompting the user to remount the (old) toner container T which was removed last time, in place of the toner container T' mounted on the mount section 310. This makes it possible to notify the user that the amount of remaining toner in the toner container T which has was once removed is not smaller than the first predetermined amount and cause the user to remount the toner container T. As a result, it is possible to prevent wasteful disposal of the toner container T.

Note that after the toner container T has been mounted on the mount section 310, the CPU 701 acquires the identification information of the toner container T from the memory 223. This identification information is stored in the RAM 703. Then, the CPU 701 compares the identification information of the toner container T newly mounted on the mount section 310 and the identification information stored in the RAM 703, and determines whether or not the newly mounted toner container T is identical to the toner container T removed immediately before. For example, when a certain toner container T is mounted immediately after the toner container T containing remaining toner in an amount not smaller than the first predetermined amount was removed, the CPU 701 compares the identification information items. Then, if the compared identification information items are different from each other, the CPU 701 can determine that the toner container T containing remaining toner in the amount not smaller than the first predetermined amount has been replaced by the other toner container T'.

FIG. 13C shows an example of an unmounted screen displayed on the liquid crystal display 707 when the door 26 is closed in a state in which the toner container T has not been mounted on the mount section 310. The unmounted screen displays a message prompting the user to mount the toner container T on the mount section 310.

FIG. 13D shows an example of an opening/closing screen displayed on the liquid crystal screen 707 when the door 26 is opened. The opening/closing screen displays a message prompting the user to close the door 26. However, the priority of displaying the opening/closing screen is lower than those of the above-mentioned first warning screen and the second warning screen. That is, the opening/closing screen is not displayed during display of the first warning screen or the second warning screen even in a state in which the door 26 is opened.

Incidentally, even in a case where mounting of the toner container T cannot be properly detected, it is necessary to close the first warning screen displayed on the liquid crystal display 707. This is because if the first warning screen continues to be displayed even though the user has closed the door 26, the user feels uncomfortable.

To prevent this, also in a case where the signal output from the door opening/closing SW changes from the high level to the low level, the image forming apparatus 200 according to the present embodiment hides the first warning screen. Therefore, in a state in which the user has mounted the toner container T on the mount section 310 when the first warning screen is being displayed, even in a case where the rotation sensor 203 cannot detect the protruding portion 220 e.g. due to unproper mounting, the first warning screen is closed when the user closes the door 26. Also in a case where the user closes the door 26 without mounting the toner container T on the mount section 310 when the first warning screen is being displayed, the first warning screen is closed.

Figure 14:
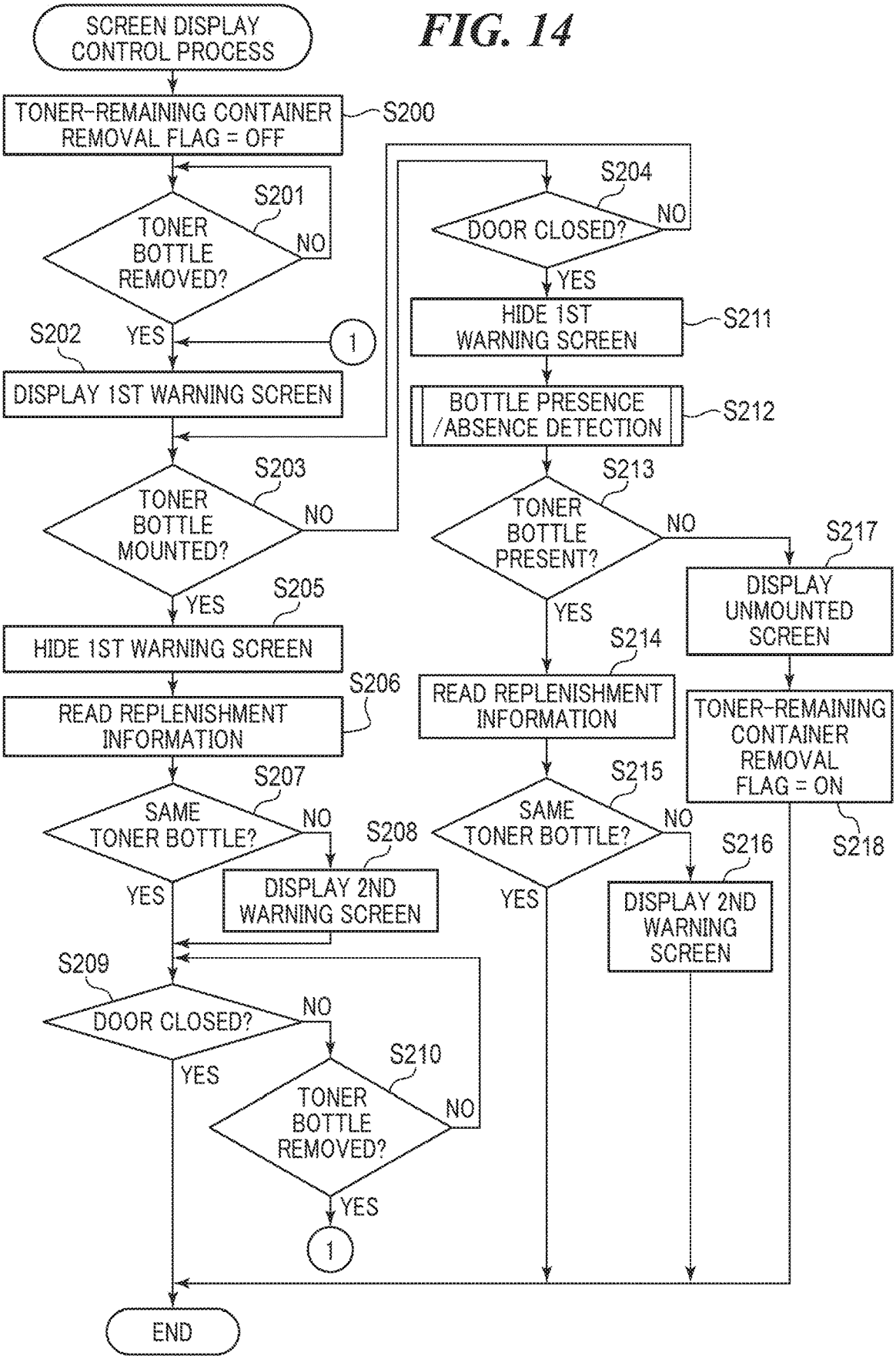
FIG. 14 is a flowchart of a screen display control process.

Next, the screen display control of the liquid crystal display 707 will be described. FIG. 14 is a flowchart of a screen display control process. This process is realized by the CPU 701 that loads an associated program stored in the ROM 702 into the RAM 703 and executes the same.

Incidentally, after the main power of the image forming apparatus 200 is turned on, the CPU 701 acquires the replenishment information of the toner container T mounted on the mount section 310 using the reading section 224, and stores the acquired information in the RAM 703. If the amount of toner in the toner container T is not smaller than the first predetermined amount and the opening/closing detection signal output from the door opening/closing SW 27 changes from the low level to the high level, the CPU 701 starts the screen display control process in FIG. 14. Therefore, normally, when the door 26 is opened in a state in which the toner container T containing remaining toner in an amount not smaller than the first predetermined amount is mounted, the screen display control is started. In this control, the CPU 701 determines whether or not the amount of toner in the toner container T is not smaller than the first predetermined amount based e.g. on the number of times of rotation of the toner container T. For example, if the number of times of rotation of the toner container T is less than a predetermined number, the CPU 701 determines that the amount of toner in the toner container T is not smaller than the first predetermined amount.

The amount of toner discharged from the toner container T per one replenishment operation is definite. Therefore, it is possible to determine the amount of remaining toner in the toner container T based on the number of times of rotation of the toner container T. The CPU 701 determines whether or not the toner container T mounted on the mount section 310 satisfies the replacement condition based on the amount of remaining toner. More specifically, the CPU 701 determines that the replacement condition is satisfied if the number of times of rotation of the toner container T is not less than the predetermined number, and determines that the replacement condition is not satisfied if the number of times of rotation of the toner container T is smaller than the predetermined number. Note that determination of satisfaction of the replacement condition is not limited to the determination based on the number of times of rotation of the toner container T. For example, in a case where even when the rotation of the toner container T does not make the amount of toner in the developing device 100 equal to or larger than the second predetermined amount, the CPU 701 may determine that this toner container T satisfies the replacement condition.

In a step S200, the SPU 701 initializes a toner-remaining container removal flag (predetermined information) as a variable stored in the RAM 703 to OFF (value=0). This toner-remaining container removal flag is used in the control (see FIG. 16), described hereinafter, performed when the door 26 is closed in a state in which the toner container is not mounted, and is opened again. In a step S201, the CPU 701 waits until the toner container T is taken out (removed) in a state in which the driving motor 604 is stopped. When the signal output from the output detection section 705 changes from the high level to the low level, the CPU 701 determines that the toner container T has been taken out, and proceeds to a step S202. Note that in a case where the door 26 is closed without removing the toner container T, the CPU 701 terminates the screen display control in FIG. 14.

In the step S202, the CPU 701 displays the first warning screen (see FIG. 13A) on the liquid crystal display 707. That is, since it is determined that the amount of toner in the toner container T is not smaller than the first predetermined amount, and the toner container T in question has been taken out, the CPU 701 prompts the user to remount the toner container T by displaying the first warning screen.

Next, in a step S203, the CPU 701 determines whether or not the toner container T has been mounted on the mount section 310. In this step, if the signal output from the output detection section 705 changes from the low level to the high level, the CPU 701 determines that the toner container T has been mounted. If it is determined that the toner container T has been mounted, the CPU 701 proceeds to a step S205. On the other hand, if the signal output from the output detection section 705 remains at the low level, the CPU 701 does not determine that the toner container T has been mounted but proceeds to a step S204. In the step S204, the CPU 701 determines whether or not the door 26 has been closed. If the opening/closing detection signal output from the door opening/closing SW 27 changes from the high level to the low level, the CPU 701 determines that the door 26 has been closed and proceeds to a step S211. On the other hand, if the opening/closing detection signal remains at the high level, the CPU 701 does not determine that the door 26 has been closed but returns to the step S203. Therefore, the CPU 701 repeats the steps S203 and S204 until the toner container T is mounted on the mount section 310 or the door 26 is closed.

In the step S205, the CPU 701 closes the first warning screen displayed on the liquid crystal display 707 (i.e. hides the first warning screen). Therefore, if mounting of the toner container T is detected, the CPU 701 hides the first warning screen even when the door 26 is in the opened state. Note that in the step S205, the CPU 701 may display another screen different from the first warning screen on the liquid crystal display 707. For example, the CPU 701 may notify the user that the operation for mounting the toner container T has been performed. Alternatively, in the step S205, another screen may be displayed on the liquid crystal display 707 by superimposing the same on the first warning screen.

Next, in a step S206, the CPU 701 reads the replenishment information from the memory 223 of the newly mounted toner container T using the reading section 224. The replenishment information includes the identification information. Next, in a step S207, the CPU 701 performs identification processing for determining whether or not the toner container T mounted on the mount section 310 is identical to the toner container T removed last time (immediately before). The identification information of the toner container T removed last time is stored in the RAM 703. Therefore, the CPU 701 determines whether or not the newly mounted toner container T is identical to the toner container T removed last time based on whether or not the identification information read in the step S206 is identical to the identification information stored in the RAM 703.

If it is determined in the step S207 that the two identification information items do not coincide with each other, i.e. the two toner containers T are not the same, in a step S208, the CPU 701 displays the second warning screen (see FIG. 13B) on the liquid crystal display 707. Therefore, even when the door 26 is in the opened state, if another toner container T' different from the removed toner container T is mounted, the CPU 701 displays the second warning screen. This makes it possible to prevent wasteful disposal of the toner container T containing remaining toner. After that, the CPU 701 proceeds to a step S209. Further, if it is determined in the step S207 that the two identification information items coincide with each other, i.e. the two toner containers T are identical, the CPU 701 proceeds to the step S209 without displaying the second warning screen.

In the step S209, the CPU 701 determines whether or not the door 26 has been closed based on whether or not the opening/closing detection signal output from the door opening/closing SW 27 has changed from the high level to the low level. If it is determined that the door 26 has been closed, the CPU 701 terminates the present screen display control. On the other hand, if the opening/closing detection signal remains at the high level, the CPU 701 does not determine that the door 26 has been closed but proceeds to a step S210.

In the step S210, the CPU 701 determines whether or not the toner container T has been removed, based on whether or not the signal output from the output detection section 705 has changed from the high level to the low level. If it is determined in the step S210 that the signal output from the output detection section 705 remains at the high level, the CPU 701 does not determine that the toner container T has been removed but returns to the step S209. Therefore, the CPU 701 repeats the steps S209 and S210 until the toner container T is removed or the door 26 is closed. On the other hand, if it is determined in the step S210 that the toner container T has been removed, the CPU 701 returns to the step S202. Therefore, if the toner container T has been mounted on the mount section 310 without closing the door 26 after closing the first warning screen, and then this toner container T is removed, the CPU 701 displays the first warning screen again.

In the step S211, the CPU 701 closes the first warning screen. Therefore, the CPU 701 hides the first warning screen in a case where the door 26 is closed without detecting mounting of the toner container T. Note that in the step S211, the CPU 701 may display another screen different from the first warning screen on the liquid crystal display 707. Alternatively, in the step S211, another screen may be displayed on the liquid crystal display 707 by superimposing the same on the first warning screen. Next, in a step S212, the CPU 701 performs a bottle presence/absence detection process described hereinafter with reference to FIG. 15. This bottle presence/absence detection process is a process for redetermining whether or not the toner container T has been mounted on the mount section 310.

Next, in a step S213, the CPU 701 determines, based on a result of the bottle presence/absence detection, whether or not the toner container T has been mounted on the mount section 310. Then, if it is determined that the toner container T has been mounted on the mount section 310, the CPU 701 proceeds to a step S214. In the step S214, the CPU 701 reads the replenishment information from the memory 223 of the mounted toner container T using the reading section 224 and proceeds to a step S215. In the step S215 and a step S216, the CPU 701 performs the same processing as the steps S207 and S208. After execution of the step S216, the CPU 701 terminates the present screen display control in a state in which the second warning screen is displayed. In this case, when the user opens the door 26 afterwards, the CPU 701 starts the screen display control again. If it is determined in the step S215 that the two identification information items coincide with each other, i.e. the two toner containers T are identical, the CPU 701 terminates the present screen display control without displaying the second warning screen.

If it is determined in the step S213 that the toner container T has not been mounted, the CPU proceeds to a step S217. In the step S217, the CPU 701 displays the unmounted screen (see FIG. 13C) on the liquid crystal display 707. Therefore, in a case where the door 26 is closed without mounting the toner container T on the mount section 310, the unmounted screen is displayed on the liquid crystal display 707. Then, the CPU 701 proceeds to a step S218, and sets the toner-remaining container removal flag stored in the RAM 703 to ON (value=1). If the toner-remaining container removal flag is ON, this indicates that the door 26 has been closed in a state in which the toner container T containing toner in an amount not smaller than the first predetermined amount has been removed. After execution of the step S218, the CPU 701 terminates the present screen display control in a state in which the unmounted screen is being displayed on the liquid crystal display 707.

According to the steps S205 and S211, when the protruding portion 220 of the toner container T is detected by the rotation sensor 203, or when closing of the door 26 is detected by the door opening/closing SW 27, the first warning screen is hidden. Alternatively, another screen is superimposed on the first warning screen.

Figure 15:
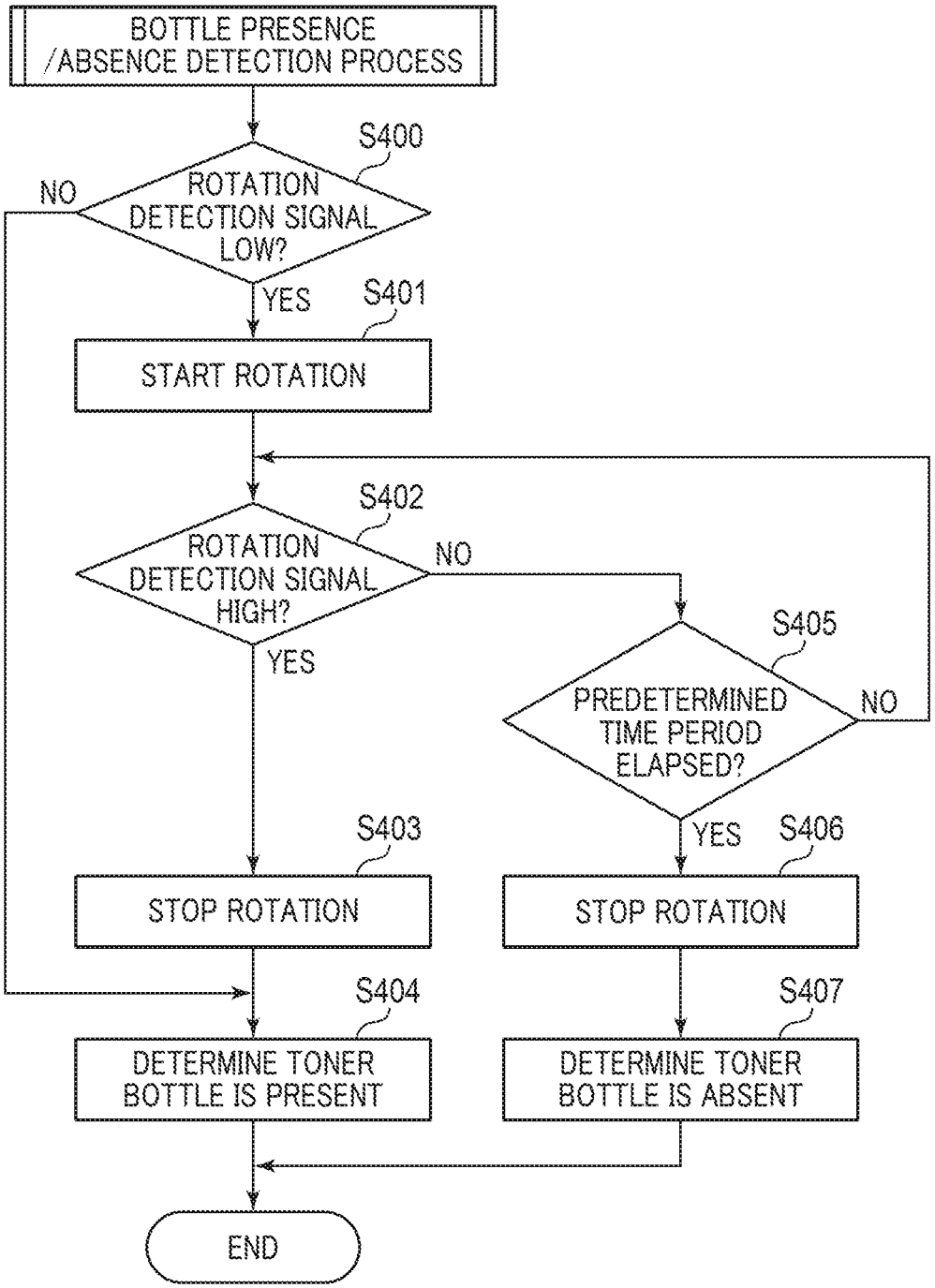
FIG. 15 is a flowchart of a bottle presence/absence detection process.

FIG. 15 is a flowchart of the bottle presence/absence detection process performed in the step S212 in FIG. 14. This bottle presence/absence detection process is a process for redetermining whether or not the toner container T has been mounted on the mount section 310 in a case where the door 26 is closed without detecting mounting of the toner container T.

First, in a step S400, the CPU 701 determines whether or not the signal output from the output detection section 705 is at the low level. As mentioned above, in a case where the toner container T has been mounted on the mount section 310 at the predetermined rotational angle, the output detection section 705 outputs the signal at the high level. However, in a case where the toner container T has been mounted on the mount section 310 at a rotational angle different from the predetermined rotational angle, the output detection section 705 outputs the signal at the low level. Further, also in a case where the toner container T has not been mounted on the mount section 310, the output detection section 705 outputs the signal at the low level.

If it is determined in the step S400 that the output detection section 705 outputs the signal at the low level, in a step S401, the CPU 701 starts to drive the driving motor 604. That is, the CPU 701 sets the PWM value stored in the RAM 703 to the motor driving section 704 and outputs the ENB signal to the motor driving section 704. Upon receipt of the ENB signal, the driving motor 604 is driven to start rotating the toner container T. After the driving of the driving motor 604 is started, the CPU 701 starts measurement of time using a timer (not shown). On the other hand, if it is determined in the step S400 that the output detection section 705 outputs the signal at the high level, the CPU 701 proceeds to a step S404. In this case, the rotation sensor 203 has detected the protruding portion 220 and hence the CPU 701 determines that the toner container T has been mounted on the mount section 310 (the toner container T is present).

After the driving of the driving motor 604 is started, in a step S402, the CPU 701 determines whether or not the signal output from the output detection section 705 is at the high level. In this step, if the toner container T has been mounted on the mount section 310, by rotating the toner container T, the protruding portion 220 of the toner container T is soon detected by the rotation sensor 203. That is, if the toner container T has been mounted on the mount section 310, the signal output from the output detection section 705 changes from the low level to the high level after driving the driving motor 604.

If it is determined in the step S402 that the signal output from the output detection section 705 is at the low level, the CP U701 proceeds to a step S405. In the step S405, the CPU 701 determines, based on a result of the measurement by the timer, whether or not a predetermined time period has elapsed after the driving motor 604 started to be driven. In this step, the predetermined time period is set to a time period sufficient for the rotation sensor 203 to detect the protruding portion 220 after the driving motor 604 starts to be driven. Then, if the predetermined time period has not elapsed after the driving motor 604 started to be driven, the CPU 701 returns to the step S402. Therefore, the CPU 701 continues to cause the driving motor 604 to be driven until the signal at the high level is output from the output detection section 705 or the predetermined time period elapses after the driving motor 604 started to be driven.

If it is determined in the step S402 that the signal output from the output detection section 705 is at the high level, the CPU 701 proceeds to a step S403, and stops the ENB signal to stop driving the driving motor 604. When the driving of the driving motor 604 is stopped, the CPU 701 stops measurement of time using the timer. Next, in the step S404, the CPU 701 determines that the toner container T has been mounted on the mount section 310, followed by terminating the process in FIG. 15.

If it is determined in the step S405 that the predetermined time period has elapsed after the driving motor 604 started to be driven, it is possible to determine that the protruding portion 220 cannot be detected by the rotation sensor 203 even though the operation for rotating the toner container T is continued for the predetermined time period. Then, in a step S406, the CPU 701 stops the ENB signal to stop driving the driving motor 604, and stops measurement of time using the timer. Then, in a step S407, the CPU 701 determines that the toner container T has not been mounted on the mount section 310 (the toner container T is not present).

After execution of the step S404 or S407, the CPU 701 terminates the bottle presence/absence detection process in FIG. 15. According to the present process, even in a case where the protruding portion 220 of the toner container T is not detected by the rotation sensor 203 when the door 26 is closed, it is possible to determine that the toner container T has been mounted on the mount section 310 by rotating the toner container T afterwards.

Next, the screen display control for displaying the first warning screen again will be described. In a conventional image forming apparatus, in a case where a screen warning that toner still remains in a toner bottle is once hidden, the warning screen is not displayed again unless removal of the toner bottle is detected again. Therefore, the user may mount not the toner bottle in which toner still remains but a new toner bottle. To solve this problem, in the present embodiment, an opportunity to display the first warning screen again is provided.

Figure 16:
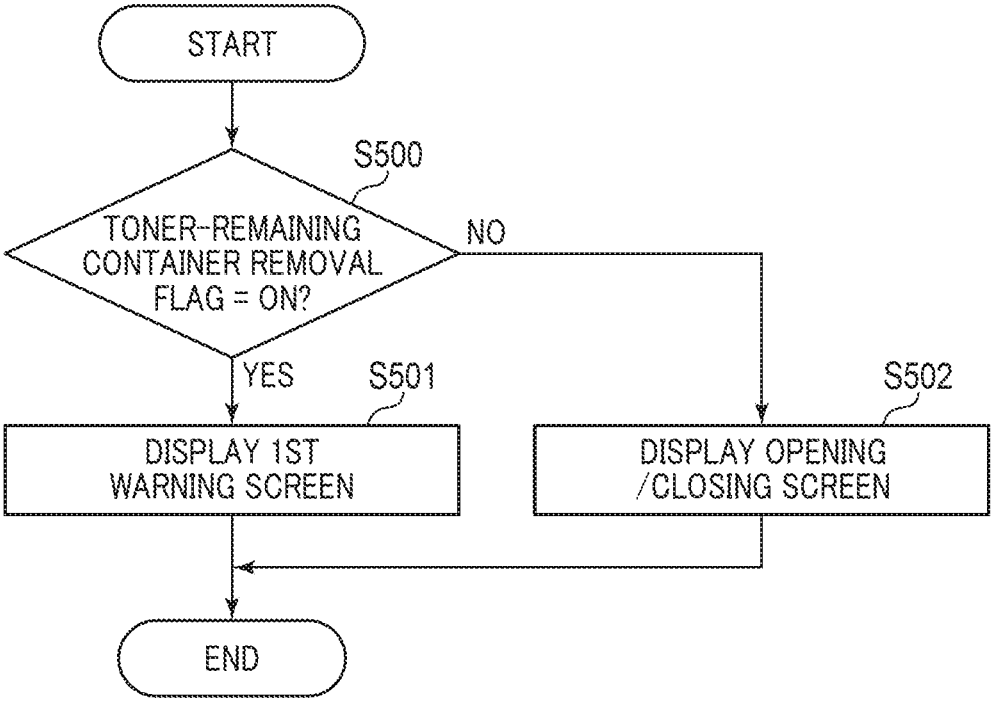
FIG. 16 is a flowchart of a screen redisplay process for a warning screen.

FIG. 16 is a flowchart of a redisplay control process for a warning screen. This process is realized by the CPU 701 that loads an associated program stored in the ROM 702 into the RAM 703 and executes the same. This process is started when the opening/closing detection signal output from the door opening/closing SW 27 changes from the low level to the high level after the screen display control process in FIG. 14 is performed.

First, in a step S500, the CPU 701 determines whether or not the toner-remaining container removal flag stored in the RAM 703 is ON. If the toner-remaining container removal flag is OFF, in a step S502, the CPU 701 displays the opening/closing screen (see FIG. 13D) on the liquid crystal screen 707, followed by terminating the present process. On the other hand, if the toner-remaining container removal flag is ON, the CPU 701 displays the first warning screen (see FIG. 13A) on the liquid crystal screen 707, followed by terminating the present process. Since the first warning screen is displayed again, it is possible to prompt the user again to remount the toner container T containing remaining toner in an amount not smaller than the first predetermined amount, at a timing when the user opens the door 26.

According to the present embodiment, if it is determined that the door 26 is closed in a state in which the first warning screen is being displayed and also the toner container T has been determined to be not mounted on the mount section 310, the CPU 701 stops displaying the first warning screen (S211). Therefore, uncomfortable feeling generated by the first warning screen continuing to be displayed in the state in which the door 26 is closed is eliminated. Further, it is possible to prevent the user from repeating mounting and removal of the toner container T, and hence it is possible to reduce down time of the image forming apparatus 200. Further, if it is determined that the door 26 is opened thereafter, the CPU 701 displays the first warning screen again (S501). With this, it is possible to perform the notification again so as to prompt the user to remount the toner container T which does not satisfy the replacement condition even after the notification is once terminated because the door 26 is closed. Therefore, it is possible to improve the usability of the image forming apparatus on which the toner container T replaceably mounted. Note that the warning screen displayed on the liquid crystal screen in the step S501 may be a screen different from the first warning screen displayed in the step S202, insofar as it is a screen for prompting the user to remount the toner container T.

Further, in a case where the display of the first warning screen is stopped according to closing of the door 26 in a state in which the toner container T is not mounted, whether or not the toner container T has been mounted is determined again in the state in which the door 26 is closed (S212 and S213). With this, even when the toner container T has been mounted at an improper rotational angle, by determining again whether or not the toner container has been mounted, there is a possibility that the determination changes to a result indicating that the toner container T has been mounted, by rotating the toner container T. Therefore, it is possible to correct improper mounting of the toner container T by the user. Further, as a result of the redetermination of whether or not the toner container T has been mounted, if it is determined again that the toner container T has not been mounted, the unmounted screen (see FIG. 13C) is displayed (S217), and hence it is possible to notify the user that the toner container T has not been mounted with positive proof. On the other hand, as a result of the redetermination of whether or not the toner container T has been mounted, if it is determined that the toner container T has been mounted, in a case where the mounted toner container T is not identical to the toner container T removed last time, the second warning screen (see FIG. 13B) is displayed (S216). This makes it possible to prevent wasteful disposal of the toner container T containing remaining toner.

Note that the redetermination of whether or not the toner container T is mounted is not necessarily required, i.e. the steps S212 to S216 in FIG. 14 are not necessarily required. For example, the steps S217 and S218 may be executed after execution of the step S211 to set the toner-remaining container removal flag to ON.

The first warning screen, the second warning screen, and the unmounted screen, shown in FIGS. 13A to 13C, respectively, and the replacement screen shown in FIG. 9 are examples of the various notifications using the screen display. However, the notification form is not limited to the screen display, but for example, voice may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-076896 filed Apr. 12, 2018, which is hereby incorporated by reference herein in its entirety.

What is claimed is:

1. An image forming apparatus comprising:

an image forming unit configured to form an image using developer;

a mount section on which a container containing developer is mounted;

a replenishment mechanism configured to replenish developer in the container mounted on the mount section to the image forming unit;

a cover that is opened to mount the container on the mount section and is closed to protect the container mounted on the mount section; and a display configured to display, in a case where the cover is opened after the cover is closed in a state in which the container has been removed from the mount section while a predetermined condition related to a remaining amount of the developer in the container is not satisfied, a remount screen for prompting a user to remount the removed container.

2. The image forming apparatus according to claim 1, wherein in a case where the container is removed from the mount section while the predetermined condition is not satisfied, the display further displays another remount screen for prompting the user to remount the removed container.

3. The image forming apparatus according to claim 2, wherein in the case where the cover is closed in the state in which the container has been removed from the mount section while the predetermined condition is not satisfied, the display further hides the another remount screen.

4. The image forming apparatus according to claim 2, wherein in the case where the cover is closed in the state in which the container has been removed from the mount section while the predetermined condition is not satisfied, the display displays another screen different from the another remount screen.

5. The image forming apparatus according to claim 1, wherein in the case where the cover is closed in the state in which the container has been removed from the mount section while the predetermined condition is not satisfied, the display further displays an unmounted screen for notifying the user that the container has not been mounted on the mount section.

6. The image forming apparatus according to claim 1, wherein the predetermined condition includes a condition related to a number of times of replenishment in which the replenishment mechanism replenishes the developer from the container to the image forming unit.

7. The image forming apparatus according to claim 1, wherein the replenishment mechanism replenishes the developer to the image forming unit by rotating the container mounted on the mount section, and wherein the predetermined condition includes a condition related to a number of times of rotation of the container.

8. An image forming apparatus comprising:

an image forming unit configured to form an image using developer;

a mount section on which a container containing developer is mounted;

a replenishment mechanism configured to replenish the developer in the container mounted on the mount section to the image forming unit;

a cover that is opened to mount the container on the mount section and is closed to protect the container mounted on the mount section; and a display configured to:

display, in a case where the container is removed from the mount section while a predetermined condition is not satisfied, a first screen for prompting a user to remount the removed container;

display a second screen which is different from the first screen in a case where the cover is closed after the first screen is displayed; and display the first screen again in a case where the cover is opened after the second screen is displayed.

9. The image forming apparatus according to claim 8, wherein the predetermined condition includes a condition related to a number of times of replenishment in which the replenishment mechanism replenishes the developer from the container to the image forming unit.

10. The image forming apparatus according to claim 8, wherein the replenishment mechanism replenishes the developer to the image forming unit by rotating the container mounted on the mount section, and wherein the predetermined condition includes a condition related to a number of times of rotation of the container.

11. An image forming apparatus comprising:

an image forming unit configured to form an image using developer;

a mount section on which a container containing developer is mounted;

a replenishment mechanism configured to replenish the developer in the container mounted on the mount section to the image forming unit;

a cover that is opened to mount the container on the mount section and is closed to protect the container mounted on the mount section; and a display configured to:

display, in a case where the container is removed from the mount section while a predetermined condition is not satisfied, a screen for prompting a user to remount the removed container;

hide the screen in a case where the cover is closed after the screen is displayed; and display the screen again in a case where the cover is opened after the screen is hidden.

12. The image forming apparatus according to claim 11, wherein the predetermined condition includes a condition related to a number of times of replenishment in which the replenishment mechanism replenishes the developer from the container to the image forming unit.

13. The image forming apparatus according to claim 11, wherein the replenishment mechanism replenishes the developer to the image forming unit by rotating the container mounted on the mount section, and wherein the predetermined condition includes a condition related to thea number of times of rotation of the container.

* * * * *